US006542707B2

(12) United States Patent
Muramatsu et al.

(10) Patent No.: US 6,542,707 B2
(45) **Date of Patent: *Apr. 1, 2003**

(54) METHOD AND APPARATUS FOR IMAGE FORMING CAPABLE OF EFFECTIVELY TRANSFERRING VARIOUS KINDS OF POWDER

(75) Inventors: Satoshi Muramatsu, Kanagawa-ken (JP); Nobuo Kasahara, Kanagawa-ken (JP); Nobuo Iwata, Kanagawa-ken (JP); Junichi Matsumoto, Kanagawa-ken (JP); Tomoyuki Ichikawa, Kanagawa-ken (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/987,027

(22) Filed: Nov. 13, 2001

(65) Prior Publication Data

US 2002/0106221 A1 Aug. 8, 2002

(30) Foreign Application Priority Data

Nov. 13, 2000 (JP) ..... 2000-345959

(51) Int. Cl.[7] ..... G03G 15/00; G03G 15/08

(52) U.S. Cl. ..... 399/258; 222/DIG. 1; 399/359; 406/55

(58) Field of Search ..... 399/258, 262, 399/260, 359; 222/DIG. 1, 167; 406/55

(56) References Cited

U.S. PATENT DOCUMENTS 4,835,582 A 5/1989 Kasahara et al. ..... 399/167
4,908,661 A 3/1990 Iwata et al. ..... 399/116
4,954,849 A 9/1990 Koike et al. ..... 399/402
4,975,749 A 12/1990 Tsunoda et al. ..... 399/374
4,979,727 A 12/1990 Koike et al. ..... 271/3.03

(List continued on next page.)

FOREIGN PATENT DOCUMENTS

JP 11-84873 3/1999
JP 2000-162874 6/2000
JP 2000-250312 9/2000

*Primary Examiner*—Sophia S. Chen
(74) *Attorney, Agent, or Firm*—Oblon, Spivak, McClelland, Maier & Neustadt, P.C.

(57) ABSTRACT

A powder pump includes a stator and a rotor. The stator has a through-hole formed with two grooves extended in a stator spiral form. The rotor is rotated inside the through-hole of the stator. The rotor extends in a rotor spiral form such that spaces for accommodating a powder are formed between an outer circumferential surface of the rotor and an inner circumferential surface of the through-hole of the stator. The rotor is rotated to move the spaces and to transfer the powder. A cross-sectional engagement amount formed in the stator. An outer diameter engagement amount is formed in the rotor. When the rotor has a cross-sectional diameter RA millimeters and an outer diameter RB millimeters, and the through-hole of the stator has a least inner diameter SN millimeters and a largest inner diameter SX millimeters, RA, RB, SN, and SX are defined to satisfy formulas of $$RA-SN \geqq 0.4$$

and $$RB-(SN+SX)/2 \geqq 0.4.$$

71 Claims, 12 Drawing Sheets

U.S. PATENT DOCUMENTS 5,008,711 A 4/1991 Sakamoto et al. ..... 399/24
5,014,091 A 5/1991 Koike et al. ..... 399/405
5,162,859 A 11/1992 Hirono et al. ..... 399/54
5,386,274 A 1/1995 Sanpe et al. ..... 399/101
5,663,788 A 9/1997 Sanpe ..... 399/353
5,875,380 A 2/1999 Iwata et al. ..... 399/301
5,953,567 A 9/1999 Muramatsu et al. ..... 399/256
5,962,783 A 10/1999 Iwata et al. ..... 73/488
5,987,298 A 11/1999 Muramatsu et al. ..... 399/359
6,112,046 A 8/2000 Suzuki et al. ..... 399/359
6,122,468 A 9/2000 Sakamoto et al. ..... 399/223
6,128,459 A 10/2000 Iwata et al. ..... 399/301
6,142,690 A 11/2000 Yoshimura et al. ..... 400/636.2
6,163,669 A 12/2000 Aoki et al. ..... 399/159
6,201,941 B1 3/2001 Kasahara et al. ..... 399/258
6,393,241 B1 5/2001 Matsumoto et al. ..... 399/258
6,249,304 B1 6/2001 Sawayama et al. ..... 347/228
6,282,396 B1 8/2001 Iwata et al. ..... 399/301
6,295,437 B1 9/2001 Hodoshima et al. ..... 399/346
6,308,027 B1 10/2001 Obu et al. ..... 399/110
6,381,435 B2 4/2002 Shinohara et al. ..... 399/301

METHOD AND APPARATUS FOR IMAGE FORMING CAPABLE OF EFFECTIVELY TRANSFERRING VARIOUS KINDS OF POWDER

CROSS-REFERENCE TO RELATED APPLICATION

This application is based on Japanese patent application, No. JPAP2000-345959 filed on Nov. 13, 2000, in the Japanese Patent Office, the entire contents of which are incorporated by reference herein.

BACKGROUND OF THE INVENTION

1. Field of the Invention

This invention relates generally to a method and apparatus for image forming. More particularly, the invention relates to effectively transferring various kinds of powder.

2. Discussion of the Background

Many image forming apparatuses such as copying machines, facsimile machines, printers, and multi-function apparatus combining features of these machines use a powder pump for transferring toner in a powder form or a two-component development agent including toner and carriers. A powder pump, which is used in image forming apparatuses, generally includes a stator having a through-hole formed with two grooves extended in a stator spiral form and a rotor configured for free rotation inside the through-hole of the stator. The rotor extends in a rotor spiral form such that spaces for accommodating a powder are formed between an outer circumferential surface of the rotor and an inner circumferential surface of the through-hole of the stator. The rotor is configured to rotate, moves the spaces, and thereby transfers the powder. One example of this type of the powder pump that is known as a single-shaft eccentric screw pump or a mono pump is described in published Japanese patent application, No. 11-84873.

A single-shaft eccentric screw pump or a mono pump is configured such that the spaces formed between the outer circumferential surface of the rotor and the inner circumferential surface of the through-hole of the stator are moved by the rotation of the rotor and consequently the powder sealed inside the spaces are transferred. Generally, the rotor is made of a rigid material such as metal or resin. The stator is made of an elastic material such as a rubber.

The inventors of the present invention realized that to configure the powder pump capable of transferring a maximum amount of the powder in a unit time, the above-described spaces should be sealed as perfectly as possible so that a suction pressure at a powder suction side of the powder pump is increased. The outer circumferential surface of the rigid rotor contacts under pressure the inner circumferential surface of the through-hole of the elastic stator so that the inner circumferential surface of the through-hole is elastically deformed. An amount of this deformation of the stator is referred to as an engagement amount. As described above, to increase the sealing of the spaces, the contact pressure between the outer circumferential surface of the rotor and the inner circumferential surface of the through-hole of the stator around the spaces may be increased as much as possible, such that the engagement amount of the stator may be increased as much as possible.

However, when the engagement amount of the stator is increased in an indiscriminate manner, a torque of the rotor is increased, and consequently a wearing of the stator by a friction between the rotor and the stator is accelerated. This causes a rapid increase of a temperature of the powder pump. If the powder which is transferred by the powder pump is adversely effected by the increase in heat, then the powder is not properly transferred. For example, if the powder is a toner or a two-component development agent including toner and carriers, the powder inevitably becomes prone to be coagulated under the influence of the increased temperature.

SUMMARY OF THE INVENTION

It is an object of the present invention to provide a method and apparatus for transferring powder. In one aspect of the invention a novel powder pump apparatus is described wherein the apparatus includes (1) a stator including a through-hole formed with two grooves extended in a stator spiral form; and (2) a rotor configured and arranged for free rotation inside the through-hole of the stator, the rotor extends in a rotor spiral form such that spaces for accommodating a powder are formed between an outer circumferential surface of the rotor and an inner circumferential surface of the through-hole of the stator, The rotor is configured to rotate so as to move the spaces and thereby transfer the powder.

When the rotor has a cross-sectional diameter of at least RA millimeters and an outer diameter of at least RB millimeters, and the through-hole of the stator has inner diameter of SN millimeters and a largest inner diameter of SX millimeters, the cross-sectional diameter RA, the outer diameter RB, the least inner diameter SN, and the largest inner diameter SX are defined to satisfy formulas of $$RA-SN \geqq 0.45$$

and $$RB-(SN+SX)/2 \geqq 0.45.$$

In another aspect of the invention, the cross-sectional diameter RA, the outer diameter RB, the least inner diameter SN, and the largest inner diameter SX may be defined to satisfy formulas of $$-0.18 \leqq RB-(SN+SX)/2-(RA-SN) \leqq 0.16.$$

In an additional aspect of the invention, the cross-sectional diameter RA, the outer diameter RB, the least inner diameter SN, and the largest inner diameter SX may be defined to satisfy formulas of $$RA-SN \geqq 0.4,$$

$$RB-(SN+SX)/2 \geqq 0.4,$$

and $$-0.18 \leqq RB-(SN+SX)/2-(RA-SN) \leqq 0.12.$$

In an additional aspect of the invention, the cross-sectional diameter RA, the outer diameter RB, the least inner diameter SN, and the largest inner diameter SX may be defined to satisfy formulas of $$RA-SN \geqq 0.5,$$

$$RB-(SN+SX)/2 \geqq 0.5,$$

and $$-0.18 \leqq RB-(SN+SX)/2-(RA-SN) \leqq 0.12.$$

In another aspect of the invention, the cross-sectional diameter RA, the outer diameter RB, the least inner diameter SN, and the largest inner diameter SX may be defined to satisfy formulas of $$RA-SN \leqq 0.9$$

and $$RB-(SN+SX)/2 \leqq 0.9.$$

In an additional aspect of the invention, the rotor may be made of a material of at least one of aluminum, polycarbonate, and a polyacetal resin.

The stator may be made of at least one of an ethylenepropylene rubber having a hardness of 50 degrees in accordance with a scale A of a Japanese Industrial Standard and a chloroprene rubber.

The rotor may be driven at a rotation speed from about 100 rpm to about 400 rpm.

In an additional aspect of the invention, the powder may be toner or a two-component development agent including toner and carriers.

In another aspect of the invention, a novel method of toner transferring is described wherein the method includes (1) forming a through-hole with two grooves extended in a stator spiral form in a stator; (2) arranging a rotor extending in a rotor spiral form such that spaces for accommodating a powder are formed between an outer circumferential surface of the rotor and an inner circumferential surface of the through-hole of the stator; and (3) rotating the rotor so that the spaces are moved to transfer the powder. When the rotor has a cross-sectional diameter RA millimeters and an outer diameter RB millimeters, and the through-hole of the stator has a least inner diameter SN millimeters and a largest inner diameter SX millimeters, the cross-sectional diameter RA, the outer diameter RB, the least inner diameter SN, and the largest inner diameter SX are defined to satisfy formulas of $$RA-SN \geqq 0.45$$

and $$RB-(SN+SX)/2 \geqq 0.45.$$

In an additional aspect of the invention, a novel image forming apparatus is described wherein the apparatus includes (1) a powder pump having a stator and a rotor. The stator has a through-hole formed with two grooves extended in a stator spiral form; (2) a rotor configured to rotate inside the through-hole of the stator. The rotor extends in a rotor spiral form such that spaces for accommodating a powder are formed between an outer circumferential surface of the rotor and an inner circumferential surface of the through-hole of the stator. The rotor is configured to rotate so as to move the spaces and consequently to transfer the powder. When the rotor has a cross-sectional diameter RA millimeters and an outer diameter RB millimeters, and the through-hole of the stator has a least inner diameter SN millimeters and a largest inner diameter SX millimeters, the cross-sectional diameter RA, the outer diameter RB, the least inner diameter SN, and the largest inner diameter SX are defined to satisfy formulas of $$RA-SN \geqq 0.45$$

and $$RB-(SN+SX)/2 \geqq 0.45.$$

Additional objects and advantages of the invention will be set forth in the following description, and in part will be evident from the description, or may be learned by practice of the invention. The objects and advantages of the invention may be realized and obtained by means of the instrumentalities and combinations particularly pointed out herein.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
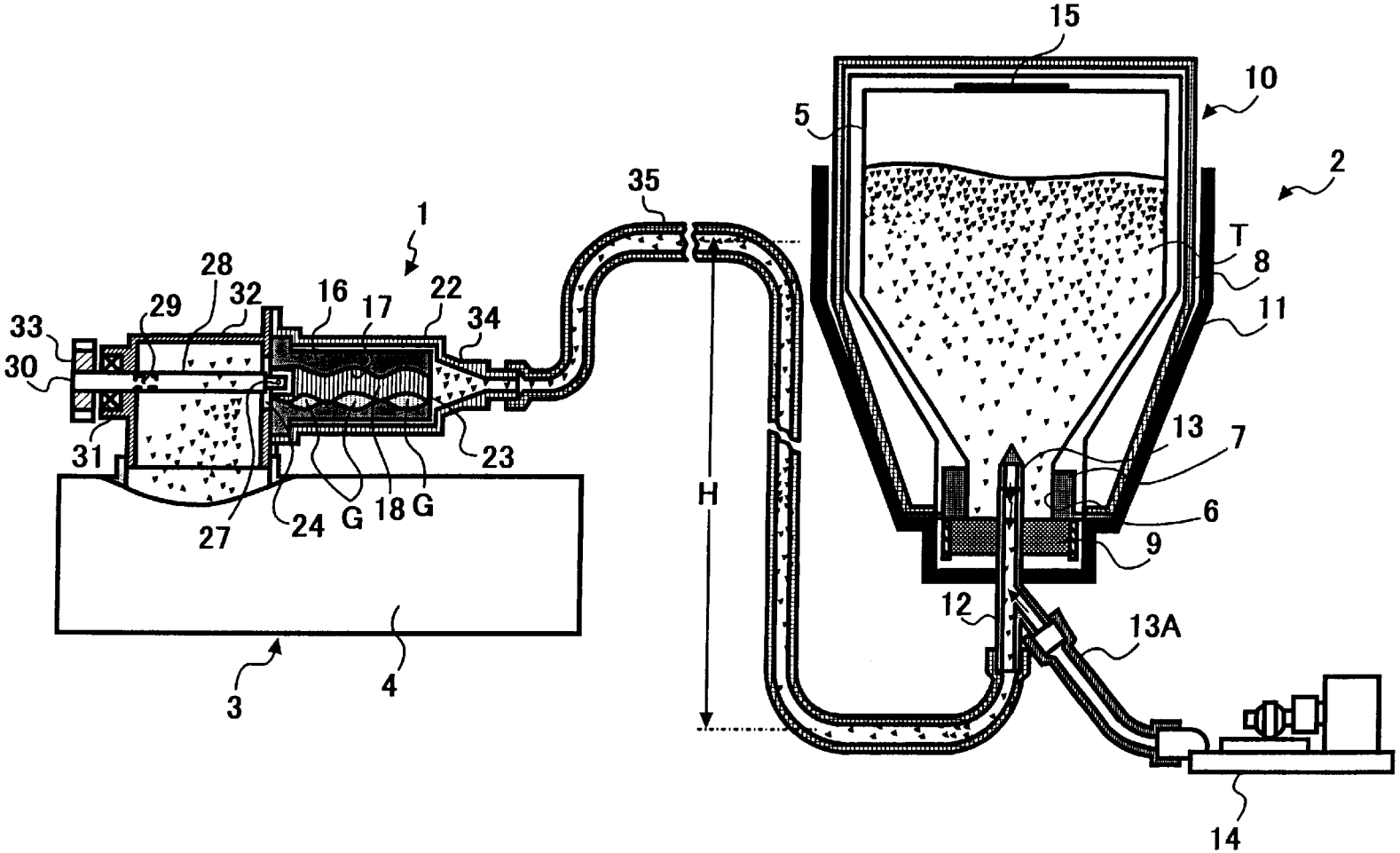
FIG. 1 is a cross-sectional view of a toner transfer apparatus including a powder pump for transferring toner from a toner hopper to a development apparatus according to a preferred embodiment.

In describing preferred embodiments illustrated in the drawings, specific terminology is employed for the sake of clarity. However, the disclosure of this patent specification is not intended to be limited to the specific terminology selected and it is to be understood that each specific element includes all technical equivalents which operate in a similar manner.

Referring now to the drawings, wherein like reference numerals designate identical or corresponding parts throughout the several views, and more particularly to FIG. 1, there is illustrated a powder supply mechanism according to a preferred embodiment of this patent specification. The powder supply mechanism of FIG. 1 is arranged inside a main body of an image forming apparatus configured as a multi-function machine including at least two of the following functions: a copying machine, a printer, and a facsimile machine.

The powder supply mechanism illustrated in FIG. 1 includes a powder pump 1, a toner container 2, and a development mechanism 3. The powder pump 1 transports toner T, as an example of a powder, contained in the toner container 2 to the development mechanism 3 which develops with the toner T an electrostatic latent image formed according to an electrophotographic method.

A so-called two-component development agent (not shown in FIG. 1) in powder form including, for example, toner and carriers is contained in a development agent container 4 of the development mechanism 3, and a toner image is formed with the toner of the development agent on the surface of an image carrying member (not shown in FIG. 1). When the toner in the two-component development agent contained in the development agent container 4 is decreased and such a reduction of a toner density is detected by a toner density sensor (not shown) of the development mechanism 3, the powder pump 1 is activated and thereby causes the toner T of the toner container 2 to be transferred into the development agent container 4.

The toner container 2 of FIG. 1 includes an inner hopper 5, having an opening 6 at its bottom, in which the powder toner T is stored. The inner hopper 5 has a lower portion, near the opening 6, which is fixedly held by a holding member 7, and is housed in a protective case 8. The protective case 8 has a lower portion fixed by the holding member 7 to which a sealing member 9, which includes an elastic substance such as a sponge, is firmly mounted. An integrated toner cartridge 10 includes the inner hopper 5, the protective case 8, the holding member 7, and the sealing member 9. This toner cartridge 10 is detachably mounted to a holder 11 which is fixed to the main body of the image forming apparatus.

Figure 2:
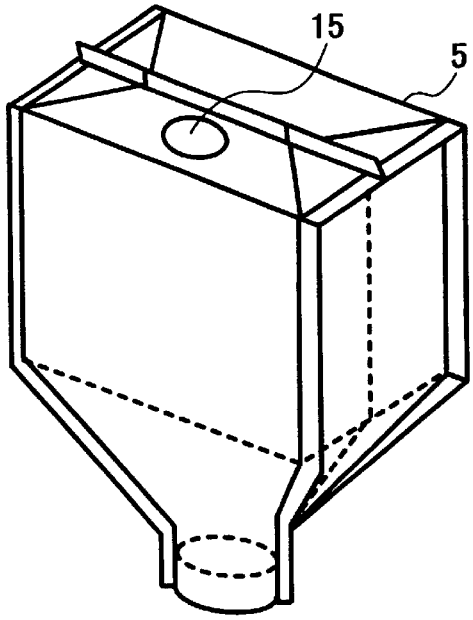
FIG. 2 is a schematic perspective view of the toner hopper.

The inner hopper 5 has a sack-like form and is made of a hermetic material including at least one layer of a flexible sheet made of at least one of a polyethylene resin, a nylon, or the like or a sheet of paper and which has a thickness roughly between 80 microns and 200 microns. To make the inner hopper 5, the above-mentioned hermetic material is configured, as illustrated in FIG. 2. The protective case 8 is made of a substance such as a hard paper, a corrugated cardboard, a plastic material, or the like, and the holding member 7 is also made of a substance such as a resin, paper, or the like.

The toner container 2 further includes a toner discharging pipe 12. To mount the toner cartridge 10, it is lowered along inside the holder 11. When the toner cartridge 10 is mounted, an upper part of the toner discharging pipe 12 is inserted into the sealing member 9 through a slit formed in the sealing member 9, so that a toner discharging opening 13 provided to one end of the toner discharging pipe 12 is entered inside the inner hopper 5. Consequently, the sealing member 9 closely contacts the circumferential surface of the toner discharging pipe 12 due to the elastic property of the sealing member 9 so that a leakage of the toner T from the inner hopper 5 is protected.

An air pipe 13A is connected to the toner discharging pipe 12 so that a quantity of air is compressed by an air pump 14 and is sent to the inner hopper 5 through the toner discharging opening 13 via the air pipe 13A and the toner discharging pipe 12. As a result, the toner T in the inner hopper 5 is mixed and is fluidized. This causes the particles of toner T to connect to each other to form a bridge and, as a result, inefficient toner T discharging is prevented. As illustrated in FIG. 2, a filter 15, which allows air but not the toner T to pass through, is provided as an upper part of the inner hopper 5. When air is sent to the inner hopper 5, as described above, the air is discharged outside through the filter 15, so that the problem of excessive pressure inside the inner hopper 5 is prevented.

Figure 3:
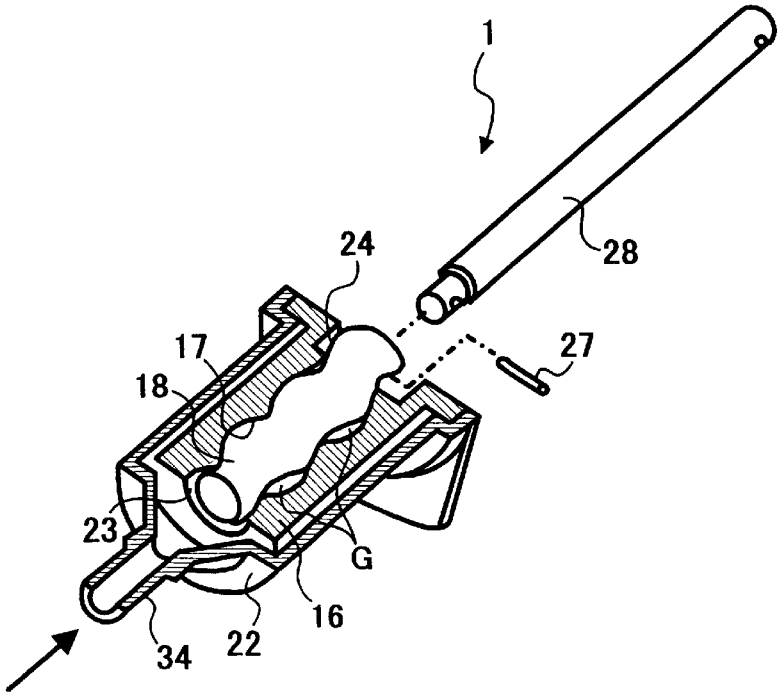
FIG. 3 is a cross-sectional perspective view of the powder pump of FIG. 1.

The powder pump 1 includes, as illustrated in FIG. 3, a stator 16 having a through-hole 17 and a rotor 18 which passes through the through-hole of the stator 16 for free rotation. The stator 16 is made of a material more elastic than a material of the rotor 18. More specifically, the stator 16 is made of an elastic member such as a rubber and the rotor 18 is made of a rigid material such as a metal, resin, or the like.

Figure 4:
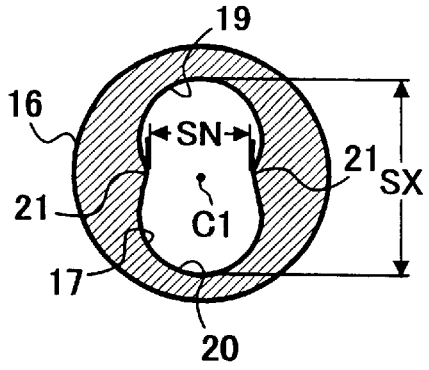
FIG. 4 is a cross-sectional view of a stator included in the powder pump of FIG. 1.
Figure 5:
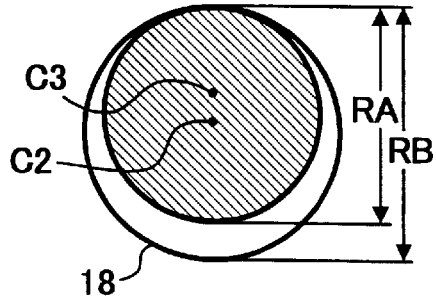
FIG. 5 is a cross-sectional view of a rotor included in the powder pump of FIG. 1.
Figure 6:
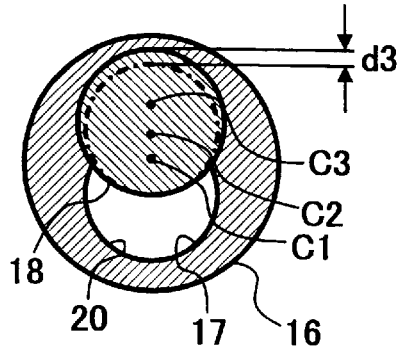
FIG. 6 is a cross-sectional view of the stator and the rotor engaged in a through-hole of the stator.
Figure 7:
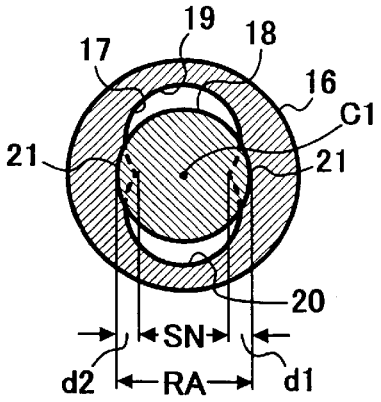
FIG. 7 is another cross-sectional view of the stator and the rotor engaged in a through-hole of the stator.

FIG. 4 is a cross-sectional view of the stator 16 in a state such that the rotor 18 is not inserted in the through-hole of the stator 16. FIG. 5 is a cross-sectional view of a single body of the rotor 18. FIGS. 6 and 7 are cross-sectional views of the stator 16 and the rotor 18 engaged with each other.

As illustrated in FIG. 4, the through-hole 17 of the stator 16 has a cross-section of two partially-overlaid helical grooves 19 and 20 extended around a center axis line C1 of the through-hole 17 and which have an equal radii. The helical grooves 19 and 20 have boundary portions 21, parts of the stator 16, where the shape of the cross-section is constricted. The boundary portions 21 of the stator 16 are preferably rounded; however a rounded shape is not necessary. For example, the shape of the cross-section of the helical grooves 19 and 20 may be in a slot-like shape.

The rotor 18 is extended in a helical shape around a center axis line C2 (FIG. 5) of the rotor 18 such that a space G for allowing the powder to pass through is formed between the circumferential surface of the rotor 18 and the inner surface of the through-hole 17, as illustrated in FIGS. 1 and 3. A cross-section of the rotor 18 has a circular form. A center C3 (FIG. 5) of the circular cross-section is eccentric relative to the center axis line C2, and the rotor 18 having such circular cross-sectional center C3 is extended in a helical form around the center axis line C2. The stator 16 with the helical-shaped rotor 18 such that the stator 16 surrounds the rotor 18, as illustrated in FIGS. 1 and 3, and is held by a casing 22. A powder pump that has the above-described stator 16 and the rotor 18 is referred to as a single-axis eccentric-screw pump or a mono pump.

In the through-hole 17, the toner T is transferred from an entrance opening 23 to an exit opening 24 of the though-hole 17. Here, an end of the rotor 18 close to the exit opening 24 is referred to as an exit end portion. To this exit end portion, a connecting shaft 28 is connected via a pin joint 27. The connecting shaft 28 is also connected, via another pin joint 29, to a driving shaft 30 which is held for free rotation via bearings 31 by a casing 32 having an open bottom. The driving shaft 30 has a portion protruding from the casing 32 to which a gear 33 is fixed. The gear 33 is engaged with another gear (not shown) which is connected to a driving motor (not shown), thereby transmitting rotation of the driving motor to the rotor 18, via the driving shaft 30, the connecting shaft 28, and so on. The casing 32 is fixed to the above-mentioned casing 22, and the casing 22 has one end side, opposite to the other side where the connecting shaft 28 locates, to which a powder entering pipe 34 is mounted with the casing 22.

The powder pump 1 of the preferred embodiment has a structure as described above, and the powder entering pipe 34 of the powder pump 1 is connected to one end of a toner transfer pipe 35. The other end of the toner transfer pipe 35 is connected to the remaining end of the toner discharging pipe 12. The toner transfer pipe 35 includes a flexible tube, for example, having an inner diameter in a range of approximately 4 mm to 7 mm and is made of a toner-resistant material such as a rubber material including polyurethane, nitrile, EPDM, silicone, or the like or plastic materials including polyethylene, nylon, or the like.

The casing 32 has a lower portion connected to the development agent container 4 of the development mechanism 3 so that inner spaces of the casing 32 and the development agent container 4 are connected to each other. When a reduction of the toner density in the two-component development agent contained in the development agent container 4 is detected, as described above, by the toner density sensor (not shown), the driving shaft 30 and the connecting shaft 28 are driven for rotation by the driving motor (not shown) and the rotor 18 is consequently rotated around the center C3 (see FIGS. 5 and 6) of the circular cross-section of the rotor 18. At the same time, the center axis line C2 of the rotor 18 is rotated around the center axis line C1 of the through-hole 17 of the stator 16. In this way, the rotor 18 is rotated such that each of the circular cross-sections is rotated while it makes a reciprocating motion between the helical grooves 19 and 20 partitioning the through-hole 17 of the stator 16, as illustrated in FIGS. 6 and 7. By the rotation of the rotor 18, the space G formed between the circumferential surface of the rotor 18 and the inner surface of the through-hole 17 of the stator 16 is shifted to the left in FIG. 1 and accordingly a suction pressure is generated at the side of the entrance opening 23 of the through-hole 17, or a side of the powder pump 1 which takes in the toner T.

Since the toner transfer pipe 35 and the toner discharging pipe 12 are sealed, the suction pressure generated as described above by the rotation of the rotor 18 of the powder pump 1 is transferred to the toner T inside the inner hopper 5 through the toner transfer pipe 35 and the toner discharging pipe 12. Thus, the toner inside the toner transfer pipe 35 is transferred into the space G through the entrance opening 23 of the through-hole 17; that is, the toner is shifted to the left in FIG. 1 and is then discharged into the casing 32 from the exit opening 24 of the through-hole 17. In this way, the powder or the toner T inside the space G is transferred from the side of the entrance opening 23 to the side of the exit opening 24 of the through-hole 17 by moving the space G by rotation of the rotor 18.

The toner T discharged through the through-hole 17 of the stator 16 is sent into the development agent container 4 and mixed with the two-component development agent contained therein. The rotor 18 is stopped in a predetermined time period so that the toner transfer process is stopped. By this process, the toner density in the development agent contained in the development agent container 4 is maintained within a predetermined range and a toner image can be formed with a predetermined toner density on the surface of the image carrying member.

During the time the development mechanism 3 is replenished with the toner T contained in the inner hopper 5 in the above-described way, the fluidity of the toner T in the inner hopper 5 increases as it is supplied with air by the air pump 14. This prevents unstable toner replenishment which may occur when the toner becomes viscous and results in a toner bridge phenomenon where the toner particles connect to each other. Therefore, the amount of the toner T that is not transferred and remains in the inner hopper 5 is minimized.

Figure 8:
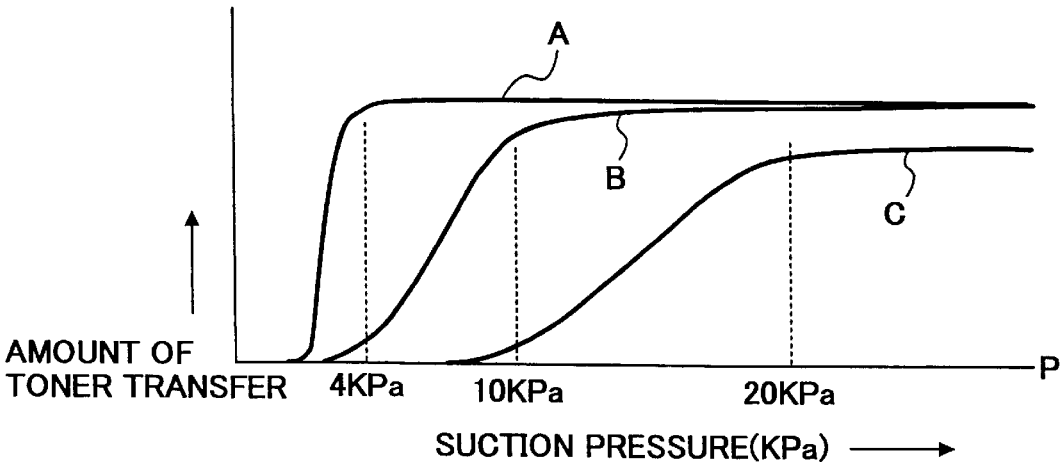
FIG. 8 is a graph for explaining a relationship between a suction pressure produced by the powder pump and a transfer amount of toner.

In this way, the powder pump 1 is configured such that the rotor 18 having a rigidity greater than that of the stator 16 contacts the inner surface of the through-hole 17 of the elastic stator 16 so as to cause an elastic deformation in the inner surface portion of the stator 16, each space G is therefore sealed, and the toner T in a powder form sealed in the space G can be transferred. In this process, as described earlier, it is necessary to increase the suction pressure at the toner suction side of the powder pump 1 in order to enable the powder pump 1 to maximize the transfer of the toner T in a unit time. FIG. 8 shows a graph of experimental results demonstrating a relationship between a suction pressure P generated at the suction side of the powder pump 1 when the powder pump 1 drew in the toner T by suction and an amount of the toner T that the powder pump 1 drew in by suction in a unit of time. Although the value of the suction pressure P is negative, its absolute value is presented in FIG. 8 and also in the description below.

Curves A, B, and C shown in the graph of FIG. 8 demonstrate the respective experimental results in which the type of toner used and the height H (see FIG. 1) were changed. The height H is the height that the powder pump 1 needed to lift the toner T by suction during the toner transfer process. Fluidity of toner depends on an amount of additives, such as a silica gel, titanium, or the like, added to the toner and the type of resin constituting the toner particles, as well as operational environmental temperature and humidity under which the powder pump 1 is driven. FIG. 8 shows that the amount of the transferred toner did not reach the maximum level when the suction pressure P was relatively low. This is because the powder pump 1 was not able to sufficiently draw in the toner, that is, the toner transfer conditions were unstable, during the time the suction pressure P was relatively low.

The curve A of FIG. 8 shows the result obtained where the toner used had a relatively preferable fluidity (i.e., a coagulation degree of between 5% and 20%) and the height H was 200 mm. The toner was successfully transferred a stable manner under this test condition. It is to be understood from FIG. 8 that this type of toner was transferred when the suction pressure P was increased to approximately 3 kPa and the maximum transfer was achieved when the suction pressure P was greater than 4 kPa. This test condition is referred to as a first condition.

The curve B of FIG. 8 shows a result obtained under a second test condition that the same type of toner was used as in the first condition, but the height H was 500 mm. In this case, a load to the powder pump 1 was increased by in response to the difference of the height H and consequently a loss of pressure occured during the time the suction pressure of the powder pump 1 was transmitted to the toner T of the inner hopper 5. Therefore, when the suction pressure P was in a range of approximately 4 kPa to 10 kPa, the toner transferred but not in a fully-stable manner. The maximum transfer was almost achieved when the suction pressure P was greater than 10 kPa.

The toner cartridge 10 of FIG. 1 is exchanged with a new cartridge when the toner T in the inner hopper 5 is fully or nearly exhausted. From the viewpoint of exchange work, it is preferable that the toner cartridge 10 is not located remotely from the development mechanism 3. Accordingly, the height H in many of the image forming apparatuses may be less than 500 mm and therefore the toner T can generally be successfully transferred to the development mechanism 3 in a stable manner when the above-mentioned second condition is satisfied.

The curve C of FIG. 8 shows a result obtained under a third condition where the toner used had a less fluidity (i.e., a coagulation degree of between 20% and 60%) and the height H was 500 mm. This test condition achieved the least favorable results. The loss of pressure was greatest during the time the suction pressure of the powder pump 1 was transmitted to the toner T of the inner hopper 5. Therefore, the toner transfer amount was converged to a maximum value and became stable when the suction pressure P was increased above 20 kPa.

If the powder pump 1 is configured to meet the third condition, the toner T may be transferred to the development mechanism 3 in a stable manner even under the worst conditions for transferring the toner, as described above.

The above-mentioned coagulation degree was measured with three sieves; a first sieve having a 150-micron mesh, a second sieve having a 75-micron mesh, and a third sieve having a 45-micron mesh. The first sieve was arranged at an uppermost position, the second sieve was arranged under the first sieve, and the third sieve was arranged at the lowermost position. Two grams of the toner were then placed on the first sieve and the three sieves were vibrated for 20 seconds. The amount of the toner left on the first sieve was referred to as x (grams), the amount of the toner left on the second sieve was referred to as y (grams), and the amount of the toner left on the third sieve was referred to as z (grams). The coagulation degree was a value presented by a formula $$(5x+3y+z)\ 10\ (\%).$$

The powder pump 1 can be configured to meet any one of the above-described first, second, or third conditions, depending upon the type of toner used and the height H. Thus, any type of toner can successively be transferred and the development mechanism can be replenished with a necessary amount of toner in a stable manner. To configure the powder pump 1 to meet the above-described conditions, a contact pressure between the portions of the rotor 18 and the stator 16 around the space G should be increased, as described earlier, so that the sealing effect of the space G is increased. This causes the portion of the stator 16 to deform and the amount of engagement becomes large, so that the sealing effect of the space G is increased. As a result, the first, second, and third conditions can be satisfied. However, an excessively large amount of the above-mentioned engagement by the portion of the stator 16 would cause a problematic phenomenon such as an increase of a rotor torque, a reduction of life of the stator 16 due to an accelerated wearing, and an increase of temperature of the powder pump 1, for example.

Figure 9:
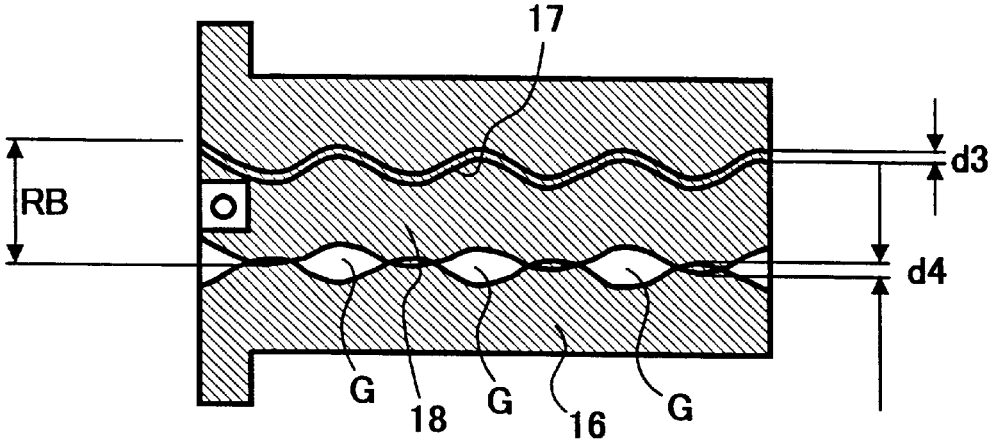
FIG. 9 is another cross-sectional view of the stator and the rotor engaged in the through-hole of the stator.

FIG. 9 is a cross-sectional view of the stator 16 and the rotor 18, and illustrates the two prior to deformation of the stator 16 by the rotor 18. This state of the stator 16 and the rotor 18 is also indicated in FIGS. 6 and 7 with dotted lines. As indicated in FIGS. 4 through 7 and FIG. 9, a diameter of the circular cross section of the rotor 18 is referred to as RA (mm) and a largest outer diameter of a helical-extended circumference of the rotor 18 is referred to as RB (mm). A least inner diameter of the through-hole 17 formed in the stator 16, that is, an inner diameter on the boundaries of the grooves 19 and 20, is referred to as SN (mm) and a largest inner diameter of the through-hole 17, that is, a distance between bottom portions of the grooves 19 and 20, is referred to as SX (mm). The least inner diameter SN and the largest inner diameter SX are the values when the stator 16 is not deformed by pressure.

FIG. 7 illustrates a manner that the rotor 18 is located at a mid position between the grooves 19 and 20, where each portion 21 of the stator 16 partitioning the boundaries of the grooves 19 and 20 is pressed by the rotor 18 and is deformed. Amounts of deformation at the portions 21 are referred to as d1 and d2, and the sum of d1 and d2 is equal to a value of RA−SN (mm), which is represented as D1 called a cross-section engagement amount for the sake of convenience.

Further, as indicated in FIGS. 6 and 9, a crest in an radial outermost portion of the rotor 18 and a trough of the grooves 19 and 20 partitioning the through-hole 17 of the stator 16, that is, a trough of the through-hole 17, contact each other under pressure and the trough of the through-hole 17 is deformed by pressure, where an amount of the deformation is referred to as d3. Another amount of deformation is referred to as d4, which deformation is generated on a crest of the through-hole 17 when the portions 21 of the stator 16 partitioning the boundaries of the grooves 19 and 20 of the through-hole 17, that is, the crest of the through-hole 17, and the crest of the rotor 18 contact each other under a strong pressure. The sum of d3 and d4 is equal to a value of RB−(SN+SX)/2 (mm), which is represented as D2 called an outer-diameter engagement amount for the sake of convenience.

In general, level of sealing the spaces G depends on an engagement amount relative to the portions of the stator 16 surrounding each of the spaces G, that is, the above-mentioned cross-section engagement amount D1, the outer-diameter engagement amount D2, and other engagement amounts associated with the stator 16. However, through the experiments herein described, it was proven that the cross-section engagement amount D1 and the outer-diameter engagement amount D2 are the most significant factors determining the perfection of the sealing the spaces G.

Figure 10:
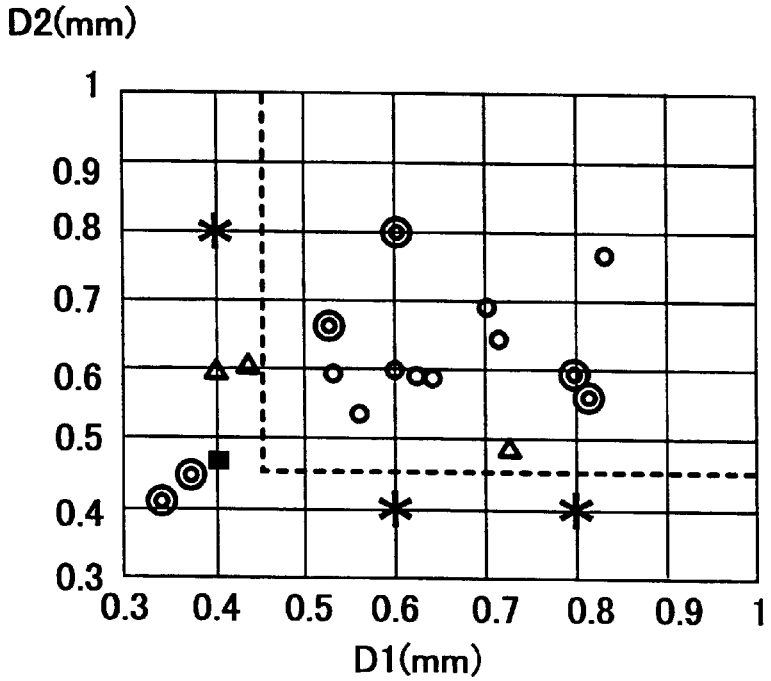
FIGS. 10–14 are graphs for explaining relationships among a cross-section engagement amount, an outer-diameter engagement amount, and a maximum suction pressure.

FIG. 10 shows experimental results demonstrating relationships among the cross-section engagement amount D1, the outer-diameter engagement amount D2, and a maximum suction pressure PM at the suction side of the powder pump 1. FIGS. 11–14 also show the experimental results in a similar manner, explained later. This experiment used the rotor 18 made of aluminum and the stator 16 made of a ethylenepropylene (i.e., EPDM) rubber having a hardness of 50 degrees, the scale A of the JIS (Japanese Industrial Standard), the powder pumps 1 which varied in the cross-section engagement amount D1 and the outer-diameter engagement amount D2, and measured the maximum suction pressure PM. The rotor 18 rotated at a speed of 200 rpm and a number of crests of the rotor 18 counted in an axis direction, i.e., a pitch of the rotor 18, was four.

In FIGS. 10–14, marks of single circles indicate the strength of the maximum pressure PM as equal to or greater than 30 kPa, black solid squares indicate it as smaller than 30 kPa and equal to or greater than 20 kPa, double circles indicate it as smaller than 20 kPa and equal to or greater than 10 kPa, triangles indicate it as smaller than 10 kPa and equal to or greater than 4 kPa, and crosses indicate it as smaller than 4 kPa. These values are also of absolute values.

Here, to meet the first condition of $P \geqq 4$ kPa, the cross-section engagement amount D1 and the outer-diameter engagement amount D2 were defined out of points indicated by the marks of crosses, that is, within a region surrounded by dashed lines and excluding the marks of crosses in FIG. 10. More specifically, the elements RA, RB, SN, and SX were defined in a way such that the conditions of $D1=RA-SN \geqq 0.45$ and $D2=RB-(SN+SX)/2 \geqq 0.45$ were satisfied. With this configuration, the powder pump 1 was able to generate the suction pressure P equal to or greater than 4 kPa which was the maximum suction pressure needed to transfer the toner T in a stable manner, as indicated by the curve A of FIG. 8. Thus, the stability of the toner transfer amount was improved. This configuration is referred to as a first configuration.

Figure 11:
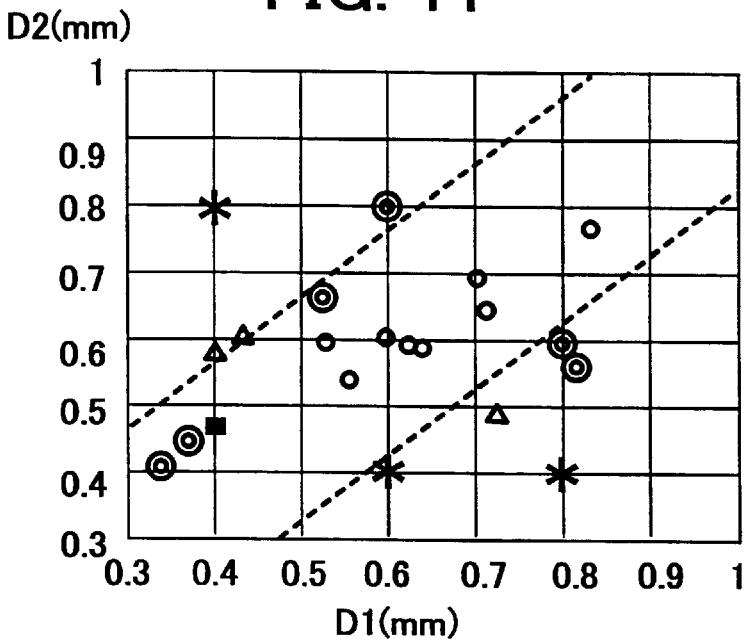

To meet the second condition of $P \geqq 10$ kPa, the cross-section engagement amount D1 and the outer-diameter engagement amount D2 were defined out of points indicated by the marks of crosses and triangles, that is, within a region sandwiched by dashed lines in FIG. 11. More specifically, the elements RA, RB, SN, and SX were defined in a way such that the conditions of $-0.18 \geqq RB-(SN+SX)/2-(RA-SN) \leqq 0.16$ was satisfied. This definition means that the cross-section engagement amount D1 and the outer-diameter engagement amount D2 were defined in a manner approximately equal to each other. With this configuration, the powder pump 1 was able to generate the suction pressure P equal to or greater than 10 kPa which was the maximum suction pressure needed to transfer the toner T in a stable manner, as indicated by the curve B of FIG. 8. Thus, the stability of the toner transfer amount was improved. This configuration is referred to as a second configuration.

Figure 12:
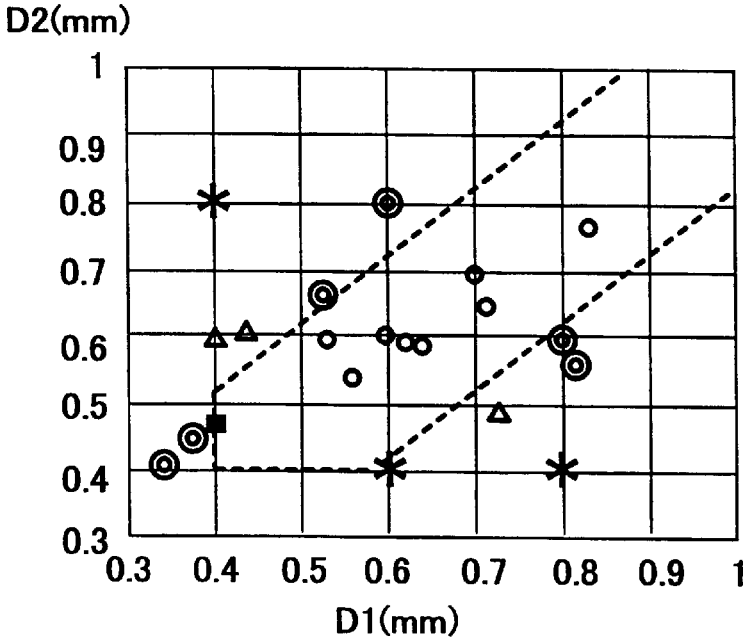

Further, to meet the third condition of $P \geqq 20$ kPa, the cross-section engagement amount D1 and the outer-diameter engagement amount D2 were defined within a region in which the maximum suction pressure was made at points indicated by the marks of circles and a solid square, that is, within a region surrounded by dashed lines in FIG. 12. More specifically, the elements RA, RB, SN, and SX were defined in a way such that the conditions of $RA-SN \geqq 0.4$ and $RB-(SN+SX)/2 \geqq 0.4$ as well as $-0.18 \leqq RB-(SN+SX)/2-(RA-SN) \leqq 0.12$ were satisfied. This definition means that the cross-section engagement amount D1 and the outer-diameter engagement amount D2 were defined in a manner approximately equal to each other. With this configuration, the powder pump 1 was able to generate the suction pressure P equal to or greater than 20 kPa which was the maximum suction pressure needed to transfer the toner T in a stable manner, as indicated by the curve C of FIG. 8. Thus, the stability of the toner transfer amount was further improved. This configuration is referred to as a third configuration.

Figure 13:
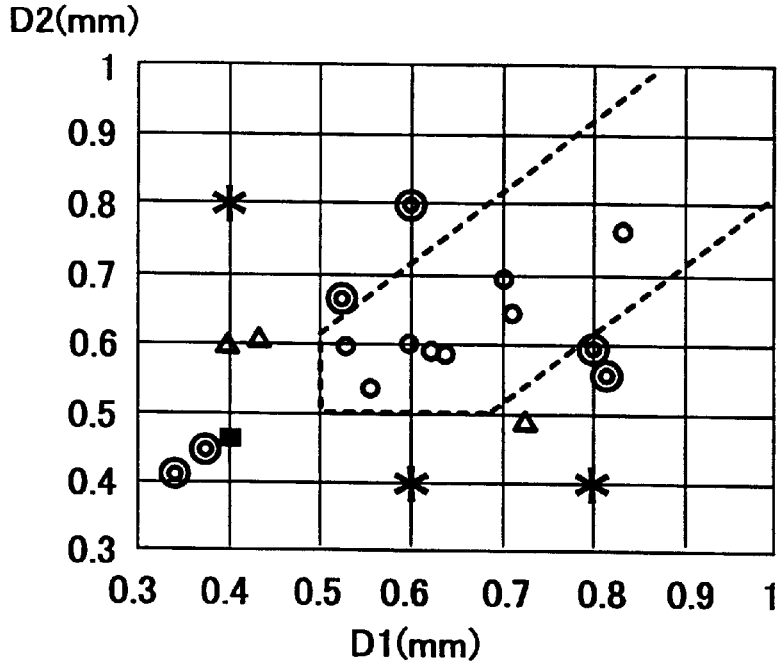

Also, it was possible that the cross-section engagement amount D1 and the outer-diameter engagement amount D2 were defined within a region in which the maximum suction pressure was made at points indicated by the marks of circles, that is, within a region surrounded by dashed lines in FIG. 13. More specifically, the elements RA, RB, SN, and SX were defined in a way such that the conditions of $RA-SN \geqq 0.5$ and $RB-(SN+SX)/2 \geqq 0.5$ as well as $-0.18 \leqq RB-(SN+SX)/2-(RA-SN) \leqq 0.12$ were satisfied. This definition means that the cross-section engagement amount D1 and the outer-diameter engagement amount D2 were defined in a manner approximately equal to each other. With this configuration, the powder pump 1 was able to generate the maximum suction pressure PM of 30 kPa or greater so as to transfer the toner even having a less fluidity. This configuration is referred to as a fourth configuration.

It should be noted that the powder pump 1 used in the above-described experiment was new, and therefore relationships of the amount D1, the amount D2, and the maximum suction pressure PM shown in FIGS. 10–14 were obtained during an initial operation time of the powder pump 1. By making both D1 and D2 relatively great, as described above, sealing of the spaces G was improved and the maximum suction pressure PM was increased. However, when the maximum suction pressure PM was excessively increased, the inner surface of the through-hole 17 of the stator 16 suffered from a relatively large friction force from the rotor 18 during the time the powder pump 1 operated and wearing of the stator 16 was accelerated, resulting in a shortened life span of the stator 16.

Figure 15:
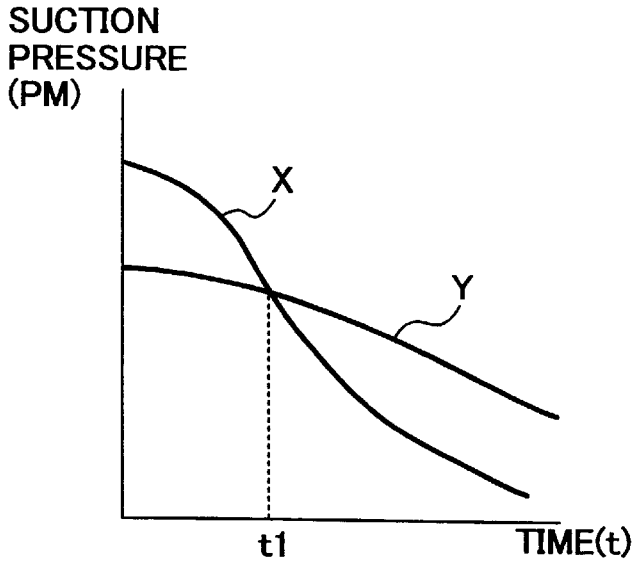
FIG. 15 is a graph representing a relationship between the maximum suction pressure and an operation time of the powder pump.

FIG. 15 shows a relationship between the maximum suction pressure PM in the vertical axis and an operation time of the powder pump 1 in the horizontal axis to explain the above-mentioned problem. In FIG. 15, a curve X represents a case in which the amounts D1 and D2 in the initial operation time of the powder pump 1 were both 1 mm and a curve Y represents a case in which the amounts D1 and D2 in the initial operation time of the powder pump 1 were both 0.7 mm. The maximum suction pressure PM of the curve X was higher than that of the curve Y by the time t1 but they were reversed on and after the time t1. That is, in case of the curve X, the maximum suction pressure PM rapidly decreased and the life of the stator 16 was shortened.

Based on this relationship of FIG. 15, it was preferable that in the powder pump 1 having one of the above-described first through to fourth configurations, the elements RA, RB, SN, and SX were defined in a way such that the conditions of $RA-SN \leqq 0.9$ and $RB-(SN+SX)/2 \leqq 0.9$ were satisfied. This configuration is referred to as a fifth configuration.

Figure 14:
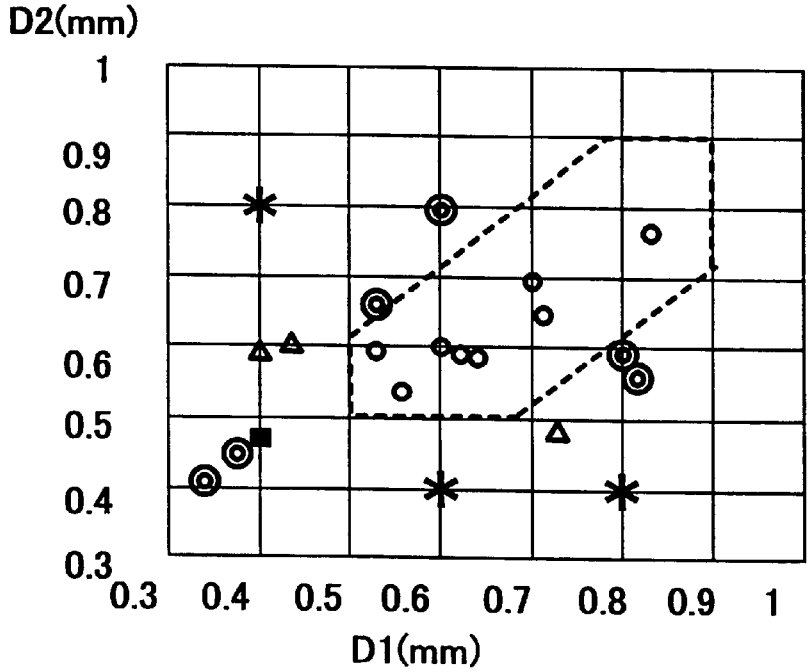

To apply the fifth configuration to the fourth configuration, the cross-section engagement amount D1 and the outer-diameter engagement amount D2 were defined to values within the region surrounded by the dashed lines of FIG. 14. That is, the elements RA, RB, SN, and SX were defined in a way such that the conditions of $0.5 \leqq RA-SN \leqq 0.9$ and $0.5 \leqq RB-(SN+SX)/2 \leqq 0.9$ as well as $-0.18 \leqq RB-(SN+SX)/2-(RA-SN) \leqq 0.12$ were satisfied.

With the above-described fifth configuration, the powder pump 1 was able to transfer the toner in a stable manner and to have a relatively longer life span.

Thus, attention was given to the cross-section engagement amount D1 and the outer-diameter engagement amount D2, which greatly affected the sealing of the spaces G and they were provided with appropriate values, avoiding indiscriminately increasing a deformation of the stator 16 caused by the pressure of the rotor 18, i.e., an engagement amount of the rotor 18 into the stator 16. Thereby, the powder pump 1 having one of the above-described first through to fifth configurations was able to have a longer life span and to stably transfer a maximum amount of toner in a unit time.

There were several conditions to be considered when the cross-section engagement amount D1 and the outer-diameter engagement amount D2 were actually determined, and it is preferable to determine the most appropriate values for the amounts D1 and D2 as well as for a difference of the amounts D1 and D2 in accordance with the conditions. For example, such conditions including the character of the powder transferred, the height H, a distance that the powder was transferred (i.e., a toner transfer distance from the inner hopper 5 to the powder pump 1 in FIG. 1), a required operation time of the powder pump 1, operational environments of the powder pump 1 (i.e., an inner temperature of the image forming apparatus), and so forth.

In addition, the experimental results also proved that the suction pressure of the powder pump 1 varied in relation to factors such as the materials of rotor and stator, a hardness of the stator, a number of rotation and pitch of the rotor, as well as other factors. Accordingly, it is preferable to have these factors taken into consideration to determine the amounts D1 and D2 as well as for a difference of the amounts D1 and D2.

Tables 1–3 represent the experimental results. In these experiments, the powder pump 1 that was new has the amounts D1 and D2 set to 0.6 mm, the number of pitch set to four, and the cross-sectional diameter of the rotor 18 set to 7 mm.

Specifically, Table 1 represents the results of the experiments that studied how the maximum suction pressure PM was differently varied depending on materials used for the rotor 18 during the initial operation period of the powder pump 1 as well as after the powder pump 1 was operated for thirty hours. In the experiments, the rotor 18 was rotated at 200 rpm and the stator 16 was made of ethylenepropylene (EPDM) rubber. The polycarbonate-TEFLON-coated rotor 18 was also used in the experiments of Table 1. TEFLON is a trademark of E. I. du Pont de Nemours & Company and a generic terminology of TEFLON is polytetrafluoroetylene. In Table 1, column A represents materials of the rotor 16, column B represents the maximum suction pressure PM (kPa) during the initial operation time, column C represents the maximum suction pressure PM (kPa) after the powder pump 1 operated for thirty hours, and column D represents a judgment. In the judgment column D of Table 1, a circular mark is provided when the maximum suction pressure PM was equal to or greater than 10 kPa in both cases during the initial operation time and after the powder pump 1 operated for thirty hours. A triangular mark is provided when the maximum suction pressure PM was equal to or greater than 4 kPa and less than 10 kPa. A cross mark is provided when the maximum suction pressure PM was less than 4 kPa. In other words, the circular mark means that the second condition was satisfied, the triangular mark means that the first condition was satisfied, and the cross mark means that none of the first, second, and third conditions was satisfied.

TABLE 1

| A | B | C | D |
|---|---|---|---|
| Aluminum | 33 | 13 | |
| Polycarbonate | 35 | 7 | |
| Fluoro-polycarbonate | 30 | 13 | |
| Polycarbonate-TEFLON-coated | 38 | 7 | |
| poly-acetal resin | 30 | 6 | |
| ABS resin | 34 | 0 | x |
| Ni-coated ABS resin | 37 | 2 | x |

Table 2 represents the results of the experiments that studied how the maximum suction pressure PM varied depending on hardness and materials of the stator 16 during the initial operation period of the powder pump 1 and after the powder pump 1 was operated for thirty hours. In the experiments, the rotor 18 was rotated at 200 rpm and the polycarbonate rotor 18 was used. In Table 2, column A represents materials of the stator 16, column A1 represents a hardness of the material shown left in the same row, wherein the hardness is in accordance with the scale A of the JIS, column B represents the maximum suction pressure PM (kPa) during the initial operation time, column C represents the maximum suction pressure PM (kPa) after the powder pump 1 operated for thirty hours, and column D represents a judgment. In the judgment column D of Table 2, a circular mark represents when the maximum suction pressure PM was equal to or greater than 10 kPa in both cases during the initial operation time and after the powder pump 1 operated for thirty hours. A triangular mark represents when the maximum suction pressure PM was equal to 4 kPa or greater and smaller than 10 kPa. A cross mark represents when the maximum suction pressure PM was smaller than 4 kPa. In other words, the circular mark means that the second condition was satisfied, the triangular mark means that the first condition was satisfied, and the cross mark means that none of the first, second, and third conditions was satisfied.

TABLE 2

| A | A1 | B | C | D |
|---|---|---|---|---|
| EPDM | 40 | 31 | 10 | |
| EPDM | 50 | 41 | 5 | |
| EPDM | 60 | 32 | 0 | x |
| Chloroprene rubber | 40 | 30 | 12.2 | |
| Chloroprene rubber | 50 | 30 | 8.6 | |
| Chloroprene rubber | 60 | 37 | 0 | x |
| Natural rubber | 40 | 30 | 0 | x |

From Table 1, it can be understood that preferable results were achieved when the material of the rotor 18 was other than the ABS resin and the Ni-coated ABS resin. Therefore, when the powder pump 1 having one of the above-described first through to fifth configurations used the rotor 18 made of at least one of aluminum, polycarbonate, and a polyacetal resin, it became able to obtain a relatively great amount of the maximum suction pressure and to transfer a sufficient amount of toner in a stable manner in both during the initial operation time and after operating for thirty hours. This configuration is referred to as a sixth configuration.

From Table 2, it is understood that preferable results were achieved when the material of the stator 16 was EPDM having the hardness of 40 degrees or 50 degrees or the chloroprene rubber having the hardness of 40 degrees or 50 degrees. Therefore, when the powder pump 1 having one of the above-described first through to sixth configurations used the stator 16 made of at least one of EPDM and the chloroprene rubber both having the hardness of 50 degrees or less, it became able to obtain a relatively great amount of the maximum suction pressure and to transfer a sufficient amount of toner in a stable manner in both during the initial operation time and after operating for thirty hours. This configuration is referred to as a seventh configuration.

Since the above-mentioned ethylenepropylene (EPDM) rubber and the chloroprene rubber had superior in anti-wearing properties and had the hardness of 50 degrees or less, repulsion of the stator 16 against the pressure of the rotor 18 was decreased and therefore the inner surface of the through-hole 17 of the stator 16 was less worn. The powder pump 1 was thereby able to produce a sufficient amount of the maximum suction pressure even after operating for a relatively long time. It should be noted that the powder pump 1 using the stator 16 made of natural rubber having the hardness of 40 degrees was not acceptable because the maximum suction pressure was 0 kPa after the thirty-hour operation.

Table 3 shows results of the experiment that studied how the suction pressure was differently varied depending on the number of rotation of the rotor 18 in one second and in five seconds after the rotor 18 started its rotation. Therefore, the suction pressure of Table 3 is not necessarily the maximum suction pressure. In this experiment, the polycarbonate-made rotor 18 and the EPDM-rubber-made stator 16 were used. In Table 3, column A represents a number of rotor rotation (rpm), column B represents the suction pressure (kPa) one second after the powder pump 1 started the operation, and column C represents the suction pressure (kPa) five seconds after the powder pump 1 started the operation.

TABLE 3

| A | B | C |
|---|---|---|
| 50 | 1.1 | 6 |
| 90 | 2.7 | 14 |
| 100 | 3 | 14.5 |
| 200 | 7 | 27 |
| 300 | 10 | 33 |
| 400 | 16 | 34 |

From Table 3, it is understood that the powder pump 1 having one of the above-described first through seventh configurations was able to sufficiently increase the suction pressure in an extremely short time after the start of the operation when configured to be operated at the rotor rotation of from 100 rpm to 400 rpm. Accordingly, this powder pump 1 was able to transfer a sufficient amount of toner to the development mechanism 3 in an extremely short operation time.

Figure 16:
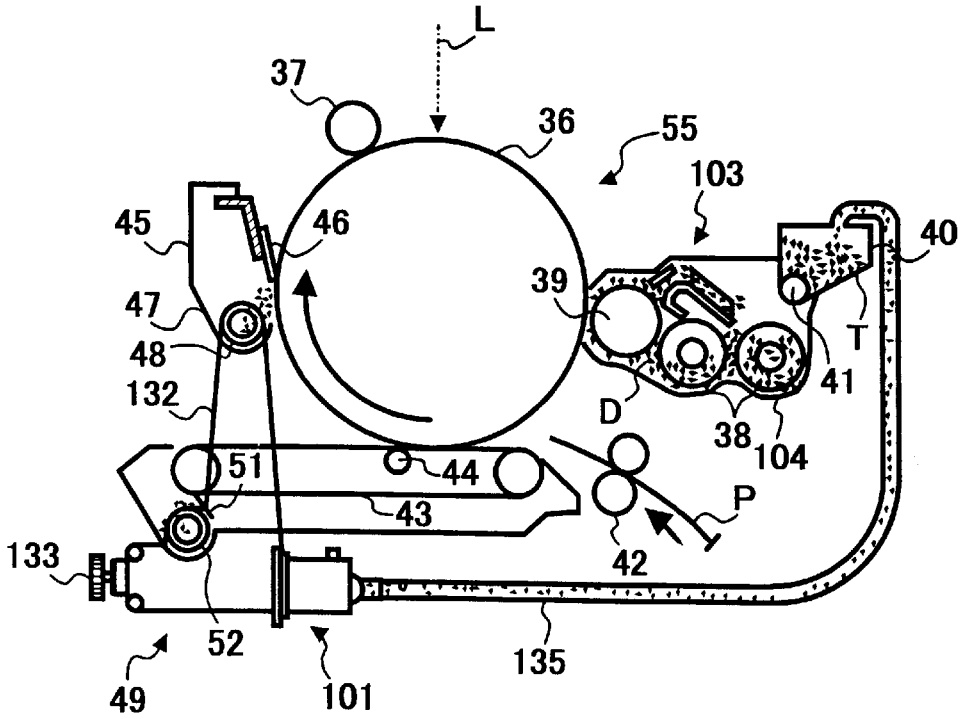
FIG. 16 is a partial sectional view of an image forming mechanism and a toner collection transfer apparatus of an image forming apparatus.
Figure 17:
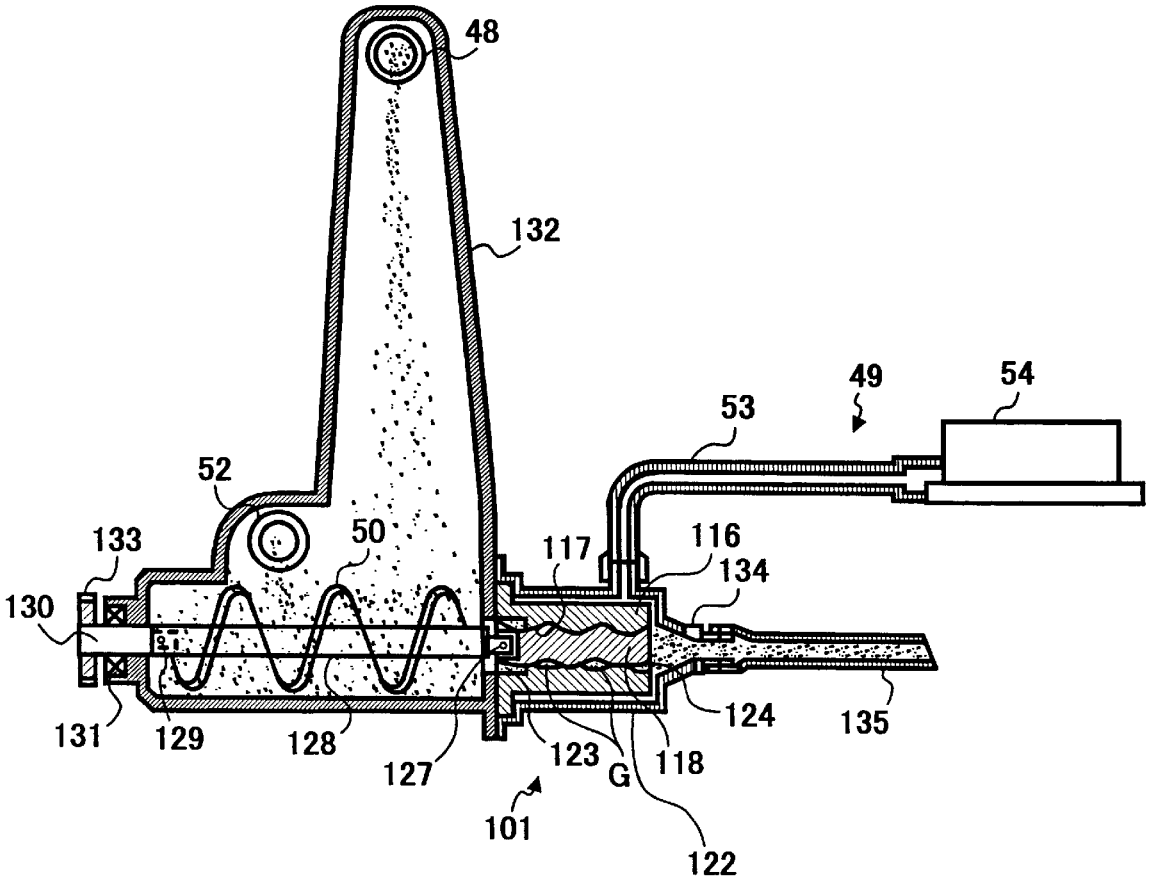
FIG. 17 is a cross-sectional view of the toner collection transfer apparatus of FIG. 16.

FIGS. 16 and 17 show an exemplary application of the powder pump 1. In this case, the powder pump 1 is used in a recycle-toner transfer apparatus that transfers the toner collected by a cleaning apparatus to a development apparatus. An image forming apparatus illustrated in FIG. 16 includes a drum-shaped photosensitive member 36 serving as an image carrying member and which is driven for rotation in a clockwise direction in FIG. 16. The photosensitive member 36 has a surface charged with a charging roller 37, and the charged surface of the photosensitive member 36 is exposed to light L, i.e., light reflected from an original or an optically-modulated laser beam. Thereby, an electrostatic latent image is formed on the surface of the photosensitive member 36, and the latent image is visualized into a toner image with a development apparatus 103.

The development apparatus 103 includes a development container 104, a mixing roller 38, a development roller 39, a toner hopper 40, and a toner replenishing roller 41. The development container 104 contains a development agent D made of powder including toner and carriers. The mixing roller 38 mixes the development agent D contained in the development container 104. The development roller 39 carries and transfers the development agent D. The toner hopper 40 contains toner T that is transferred to the development container 104 by the toner replenishing roller 41.

The development agent D is carried by the development roller 39 and is transferred to a development region formed between the development roller 39 and the photosensitive member 36. The electrostatic latent image is visualized into a toner image with the development agent D in the development region. When the toner density of the development agent D in the development container 104 is decreased, it is detected by a sensor (not shown) and the toner replenishing roller 41 is driven so as to replenish the development agent D of the development container 104 with the toner T contained in the toner hopper 40.

In the meantime, a transfer sheet P sent from a sheet cassette (not shown) is forwarded by a pair of registration rollers 42 in synchronism with the rotation of the photosensitive member 36. The transfer sheet P is then carried by a transfer belt 43 and the toner image is transferred onto the surface of the transfer sheet P by the action of a transfer voltage applied to a transfer roller 44.

The transfer sheet P is then separated from the transfer belt 43 of an image forming mechanism 55 which is structured in a way as described above, and is passing through a fixing apparatus (not shown) in which the toner image is fixed onto the transfer sheet P by heat and pressure.

A residual toner deposited on the surface of the photosensitive member 36 is removed by a cleaning blade 46 of a cleaning apparatus 45, and is collected into a cleaning case 47 of the cleaning apparatus 45. After that, the residual toner collected in the cleaning case 47 is transferred to a back side in FIG. 16 with a coil-screw 48, and is dropped down inside a duct-formed casing 132 of a recycle-toner transfer apparatus 49, as illustrated in FIG. 17.

The transfer belt 43 is pressed with a cleaning blade 51 so that a residual toner deposited on the transfer belt 43 is removed. This residual toner is also transferred to the casing 132 with the coil-screw 52.

Other than the casing 132, the recycle-toner transfer apparatus 49 includes a powder pump 101 (see FIG. 18) and a toner transfer pipe 135 made of, for example, a flexible tube, as illustrated in FIG. 17. The powder pump 101 includes a stator 116 and a rotor 118 configured in a way similar to stator 16 and the rotor 18, respectively, which are explained in the foregoing description with reference to FIGS. 1, 3–7, and 9. The stator 116 is held by a case 122. The rotor 118 is connected to a connection shaft 128 via a pin joint 127. The connecting shaft 128 is connected to a driving shaft 130 via another pin joint 129. The driving shaft 130 is held for free rotation with the casing 132 via bearings 131, and is driven via a gear 133.

Figure 18:
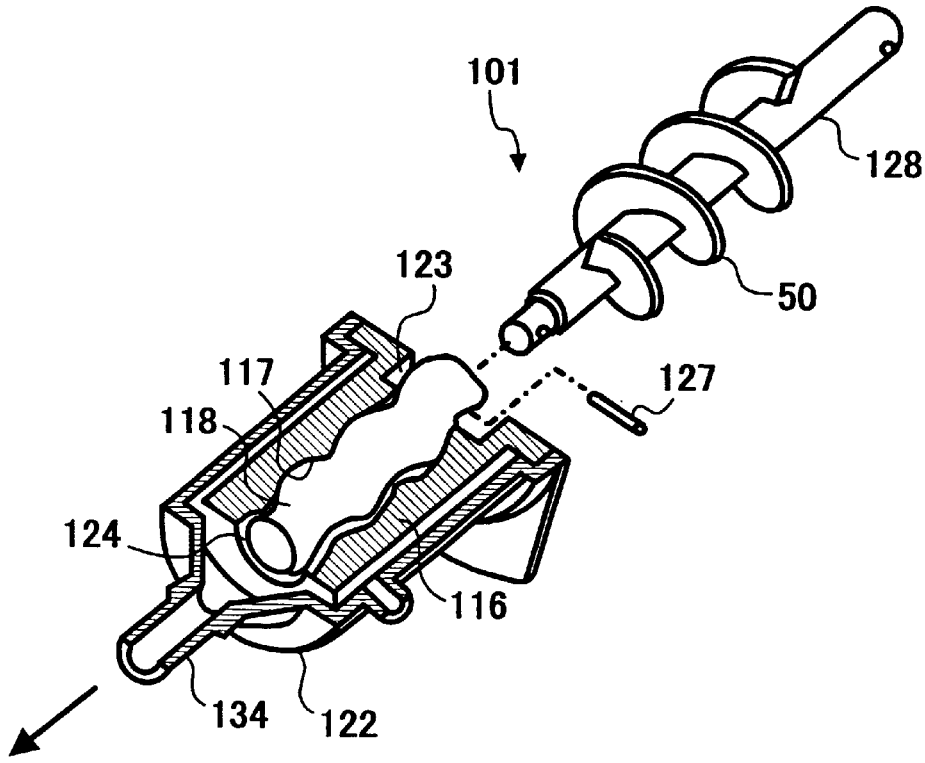
FIG. 18 is a perspective cross-sectional view of the powder pump of FIG. 17.

The powder pump 101 of FIGS. 17 and 18 is similar to the powder pump 1 of FIG. 1, except for a feature that the rotor 118 of the powder pump 101 is rotated in a reverse direction relative to the rotation of the rotor 18 shown in FIG. 1. Therefore, a side where the connecting shaft 128 locates is referred to as an entrance opening 123 of a through-hole 117 of the stator 116 and an opposite side is referred to as an exit opening 124. Further, a powder discharging pipe 134 is integrally mounted to a side of the case 122 from which the toner is discharged. The connecting shaft 128 shown in FIGS. 17 and 18 is integrated with a screw wing 50 so as to constitute a screw conveyer. In addition, an air compressed by an air pump 54 is transferred to a space formed between the stator 116 and the case 122 via an air supply tube 53. This feature is also different from the powder pump 1 of FIG. 1. One end of a toner transfer pipe 135 is connected to the powder discharging pipe 134 and the other end thereof is connected to the toner hopper 40 shown in FIG. 16.

When the connecting shaft 128 and the rotor 118 are driven, the toner dropped on the bottom of the casing 132 is transferred towards the through-hole 117 of the stator 116 by the screw wing 50 of the connecting shaft 128. A discharging pressure is consequently generated inside the powder discharging pipe 134 near the exit opening 124 of the through-hole 117. The air contained in the spaces G formed inside the through-hole 117 is ejected from the exit opening 124. At this time, the air pump 54 supplies air to the powder discharging pipe 134 so that fluidization of the air in the discharging pipe 134 is accelerated. The air is therefore transferred smoothly by the discharging pressure of the powder pump 101 through the powder transfer pipe 135 to the toner hopper 40 of the development apparatus 103 which then recycles the toner.

Although the toner returned from the photosensitive member or the transfer belt generally has an inferior fluidity, the above-described powder pump according to the preferred embodiments can efficiently transfer such toner as well.

Figure 19:
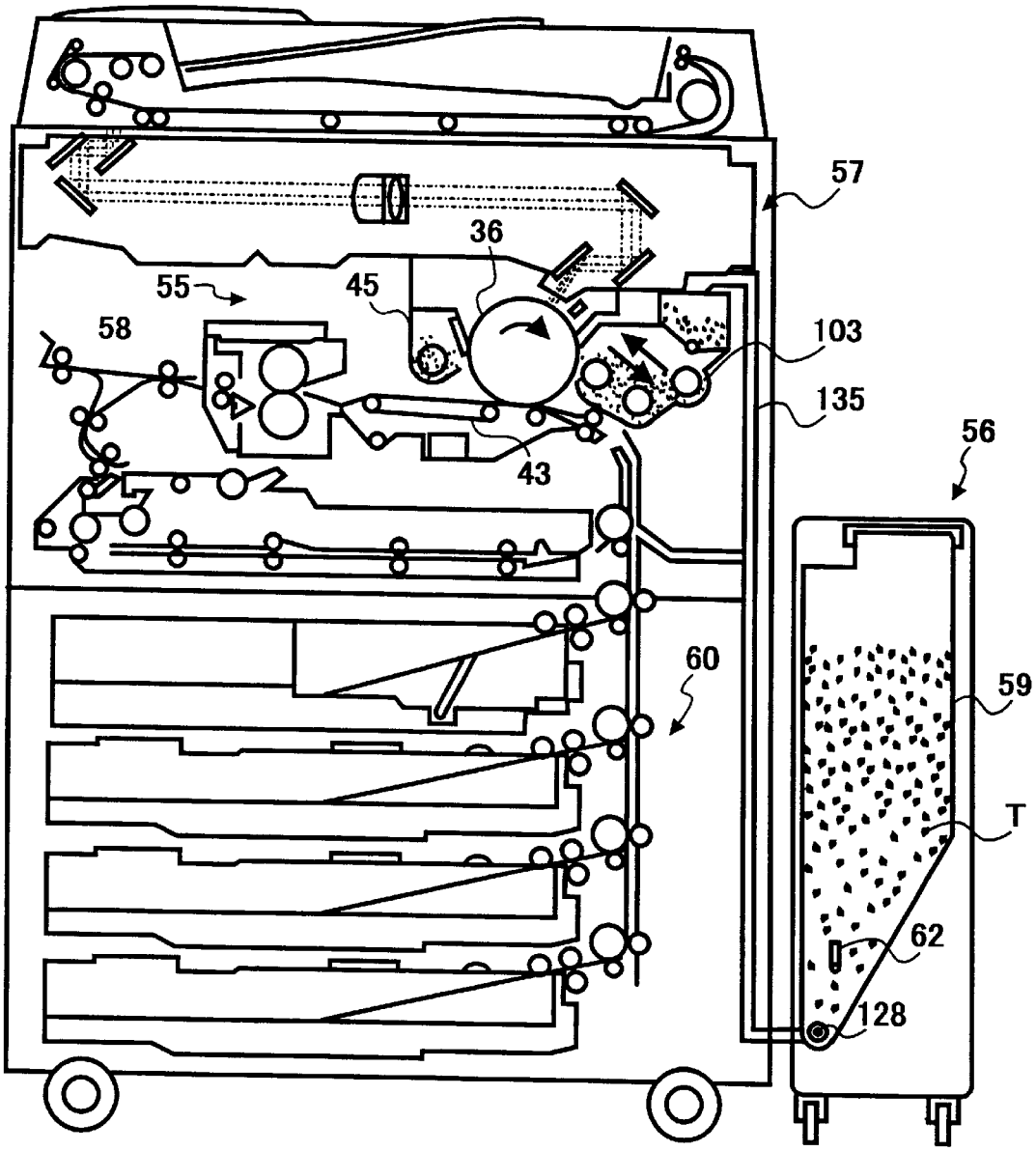
FIG. 19 is a schematic cross-sectional view of an image forming apparatus having an external large capacity toner supply apparatus.
Figure 20:
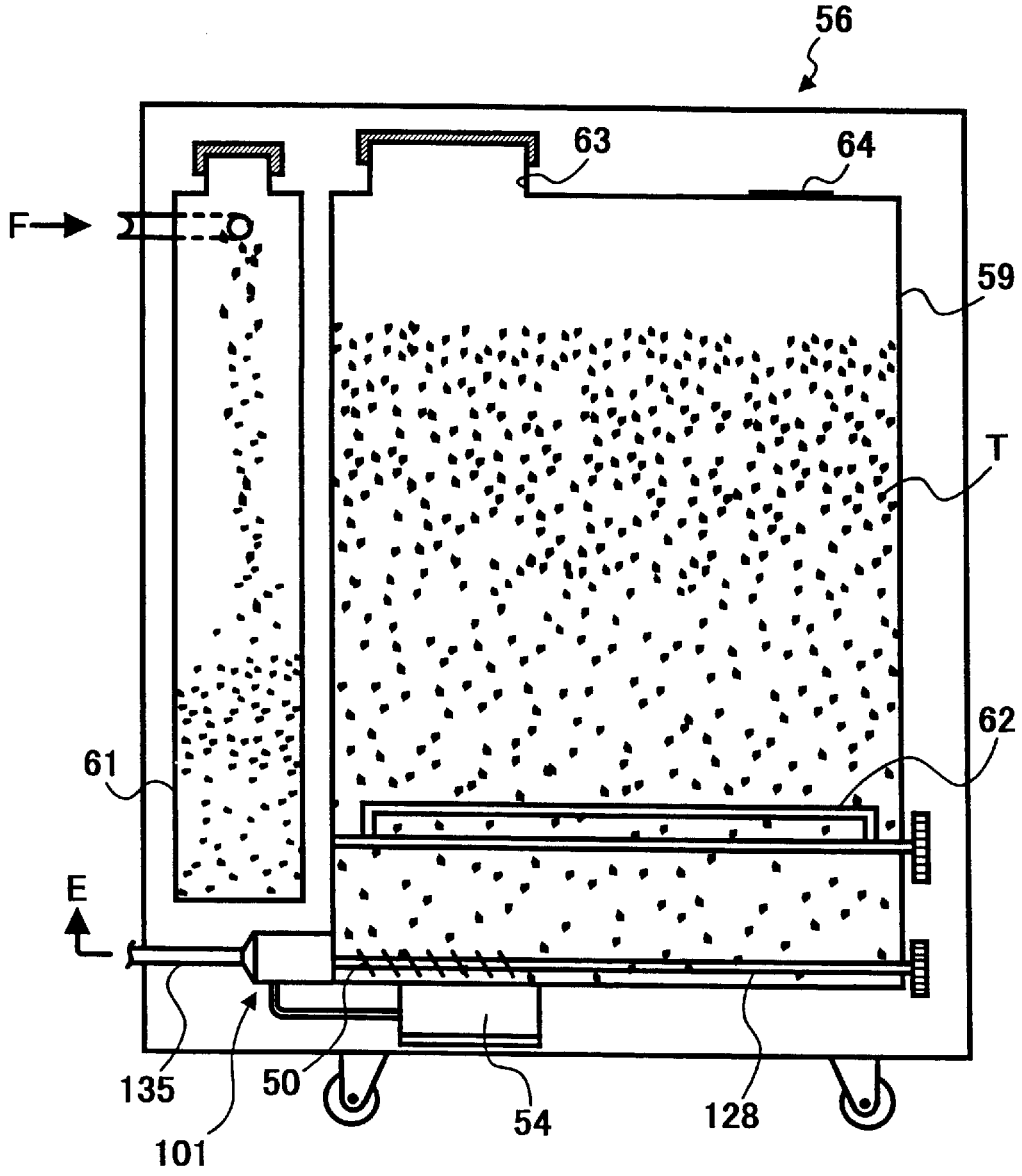
FIG. 20 is a cross-sectional view of the external large capacity toner supply apparatus of FIG. 19.

FIG. 19 shows an image forming apparatus and an external large capacity toner supply apparatus 56 connected to the image forming apparatus. FIG. 20 is a cross-section of the external large capacity toner supply apparatus 56. The image forming apparatus of FIG. 19 includes an original reading apparatus 57 which is known per se, an image forming mechanism 55 arranged under the original reading apparatus 57, a sheet supply apparatus 60 arranged under the image forming mechanism 55, and a fixing apparatus 58 for fixing a toner image formed on a transfer sheet by the image forming mechanism 55. A development apparatus 103 included in the image forming mechanism 55 is configured to be replenished with a toner T in a powder form contained in a toner tank 59 of the external large capacity toner supply apparatus 56. The toner collected from a photosensitive member 36 and a transfer belt 43 is transferred to a toner collection bottle 61 shown in FIG. 20 by a recycle toner transfer apparatus, which is not shown in FIG. 19 but can be referred to FIGS. 16 and 17. A structure of other parts of the image forming mechanism 55 is substantially similar to that shown in FIG. 16, and therefore a description is omitted.

As illustrated in FIGS. 19 and 20, the toner T contained in the toner tank 59 is mixed by an agitator 62 arranged at a lower portion of the toner tank 59, is ejected from the toner tank 59 by the powder pump 101, and is transferred to the development apparatus 103 through the toner transfer pipe 135 in a direction E. The powder pump 101 illustrated in FIG. 20 is configured in a manner substantially similar to the powder pump 101 shown in FIGS. 17 and 18, and the screw wing 50 of the connecting shaft 128 transfers the toner T contained in the toner tank 59 to a gap formed between the stator and the rotor of the powder pump 101. The powder pump 101 thus transfers the toner T with pressure, and the toner T is discharged from the gap between the stator and the rotor of the powder pump 101 and is then supplied with air by the air pump 54. Thereby, fluidization of the toner discharged from the powder pump 101 is accelerated.

When the toner T contained in the toner tank 59 is consumed, the toner tank 59 is replenished with toner through an opening 63 provided to an upper part of the toner tank 59. At this time, the air inside the toner tank 59 is drained outside through an air drain filter 64.

The toner collection bottle 61 is a toner bottle which once contained new toner and is used as the toner collection bottle 61 after it gave the contained toner to the toner tank 59. The toner collected from the cleaning apparatus 45 and the transfer belt 43, illustrated in FIG. 19, is transferred to the toner collection bottle 61 in a direction F, as illustrated in FIG. 20, through a toner transfer pipe (not shown).

The external large capacity toner supply apparatus 56 generally is selected as optional equipment for a user who uses the image forming apparatus in a relatively heavy manner. However, it is possible to configure the large capacity toner supply apparatus 56 inside the image forming apparatus as standard equipment.

In the above description, the powder pumps 1 and 101 for transferring the toner T as an example of powder are explained. The powder pumps 1 and 101 are also possible to transfer powder of a two-component development agent including toner and carriers. Furthermore, it is possible to apply the powder pump 1 and 101 to a powder pump system used other than the image forming apparatus, as well.

Numerous additional modifications and variations are possible in light of the above teachings. It is therefore to be understood that within the scope of the appended claims, the disclosure of this patent specification may be practiced otherwise than as specifically described herein.

What is claimed is:

1. A powder pump, comprising:

a stator having a through-hole formed with two grooves extended in a stator spiral form;

a rotor rotatably supported within an inside of said through-hole of said stator, said rotor extending in a rotor spiral form such that spaces for accommodating a powder are formed between an outer circumferential surface of said rotor and an inner circumferential surface of said through-hole of said stator, and said rotor rotates to move said spaces and thereby transfers said powder;

a cross-sectional engagement amount formed in said stator, the cross-sectional engagement amount according to the equation $$RA-SN \geqq 0.4 \text{ millimeters};$$

an outer diameter engagement amount formed in said rotor, the outer diameter engagement amount according to the equation $$RB-(SN+SX)/2 \geqq 0.4 \text{ millimeters};$$

wherein RA is a cross-sectional diameter of the rotor, wherein RB is an outer diameter of the rotor, wherein SN is a least inner diameter of the through-hole of the stator, wherein SX is a largest inner diameter of the through-hole of the stator.

2. The powder pump as defined in claim 1, wherein said cross-sectional diameter RA, said outer diameter RB, said least inner diameter SN, and said largest inner diameter SX are defined to satisfy a formula of $$-0.18 \leqq RB-(SN+SX)/2-(RA-SN) \leqq 0.16.$$

3. The powder pump as defined in claim 1, wherein said cross-sectional diameter RA, said outer diameter RB, said least inner diameter SN, and said largest inner diameter SX are defined to satisfy a formula of $$-0.18 \leqq RB-(SN+SX)/2-(RA-SN) \leqq 0.12.$$

4. The powder pump as defined in claim 1, wherein said cross-sectional diameter RA, said outer diameter RB, said least inner diameter SN, and said largest inner diameter SX are defined to satisfy formulas of $$RA-SN \geqq 0.5,$$

$$RB-(SN+SX)/2 \geqq 0.5,$$

and $$-0.18 \leqq RB-(SN+SX)/2-(RA-SN) \leqq 0.12.$$

5. The powder pump as defined in claim 1, wherein said cross-sectional diameter RA, said outer diameter RB, said least inner diameter SN, and said largest inner diameter SX are defined to satisfy formulas of $$RA-SN \leqq 0.9$$

and $$RB-(SN+SX)/2 \leqq 0.9.$$

6. The powder pump as defined in claim 1, wherein said rotor is made of a material of at least one of aluminum, polycarbonate, and a polyacetal resin.

7. The powder pump as defined in claim 1, wherein said stator is made of a material of at least one of an ethylenepropylene rubber having a hardness of 50 degrees in accordance with a scale A of a Japanese Industrial Standard and a chloroprene rubber.

8. The powder pump as defined in claim 1, wherein said rotor is driven at a rotation speed from about 100 rpm to about 400 rpm.

9. The powder pump as defined in claim 1, wherein said powder is toner.

10. The powder pump as defined in claim 1, wherein said powder is a two-component development agent including toner and carriers.

11. A powder pump, comprising:

stator means having a through-hole formed with two grooves extended in a spiral form; and rotor means for rotating inside said through-hole of said stator means, said rotor means extending in a rotor spiral form such that spaces for accommodating a powder are formed between an outer circumferential surface of said rotor means and an inner circumferential surface of said through-hole of said stator means, and said rotor means being configured to rotate thereby moving said spaces and transferring said powder, wherein when said rotor means has a cross-sectional diameter RA millimeters and an outer diameter RB millimeters, and said through-hole of said stator means has a least inner diameter SN millimeters and a largest inner diameter SX millimeters, said cross-sectional diameter RA, said outer diameter RB, said least inner diameter SN, and said largest inner diameter SX are defined to satisfy formulas of $$RA-SN \geqq 0.40 \text{ and}$$

$$RB-(SN+SX)/2 \geqq 0.40.$$

12. A powder pump as defined in claim 11, wherein said cross-sectional diameter RA, said outer diameter RB, said least inner diameter SN, and said largest inner diameter SX are defined to satisfy formulas of $$-0.18 \leqq RB-(SN+SX)/2-(RA-SN) \leqq 0.16.$$

13. A powder pump as defined in claim 11, wherein said cross-sectional diameter RA, said outer diameter RB, said least inner diameter SN, and said largest inner diameter SX are defined to satisfy formula of $$-0.18 \leqq RB-(SN+SX)/2-(RA-SN) \leqq 0.12.$$

14. A powder pump as defined in claim 11, wherein said cross-sectional diameter RA, said outer diameter RB, said least inner diameter SN, and said largest inner diameter SX are defined to satisfy formulas of $$RA-SN \geqq 0.5,$$

$$RB-(SN+SX)/2 \geqq 0.5,$$

and $$-0.18 \leqq RB-(SN+SX)/2-(RA-SN) \leqq 0.12.$$

15. A powder pump as defined in claim 11, wherein said cross-sectional diameter RA, said outer diameter RB, said least inner diameter SN, and said largest inner diameter SX are defined to satisfy formulas of $$RA-SN \leqq 0.9$$

and $$RB-(SN+SX)/2 \leqq 0.9.$$

16. A powder pump as defined in claim 11, wherein said rotor means is made of a material of at least one of aluminum, polycarbonate, and a polyacetal resin.

17. A powder pump as defined in claim 11, wherein said stator means is made of a material of at least one of an ethylenepropylene rubber having a hardness of 50 degrees in accordance with a scale A of a Japanese Industrial Standard and a chloroprene rubber.

18. A powder pump as defined in claim 11, wherein said rotor means is driven at a rotation speed from about 100 rpm to about 400 rpm.

19. A powder pump as defined in claim 11, wherein said powder is toner.

20. A powder pump as defined in claim 11, wherein said powder is a two-component development agent including toner and carriers.

21. A method of toner transferring, comprising the steps of:

forming a through-hole with two grooves extended in a stator spiral form in a stator; and arranging a rotor extending in a rotor spiral form such that spaces for accommodating a powder are formed between an outer circumferential surface of said rotor and an inner circumferential surface of said through-hole of said stator; and rotating said rotor so that said spaces are moved to transfer said powder, wherein when said rotor includes a cross-sectional diameter RA millimeters and an outer diameter RB millimeters, and said through-hole of said stator includes a least inner diameter SN millimeters and a largest inner diameter SX millimeters, said cross-sectional diameter RA, said outer diameter RB, said least inner diameter SN, and said largest inner diameter SX are defined to satisfy formulas of $$RA-SN \geqq 0.40$$

and $$RB-(SN+SX)/2 \geqq 0.40.$$

22. The method as defined in claim 21, wherein said cross-sectional diameter RA, said outer diameter RB, said least inner diameter SN, and said largest inner diameter SX are defined to satisfy formulas of $$-0.18 \leqq RB-(SN+SX)/2-(RA-SN) \leqq 0.16.$$

23. The method as defined in claim 21, wherein said cross-sectional diameter RA, said outer diameter RB, said least inner diameter SN, and said largest inner diameter SX are defined to satisfy formula of $$-0.18 \leqq RB-(SN+SX)/2-(RA-SN) \leqq 0.12.$$

24. The method as defined in claim 21, wherein said cross-sectional diameter RA, said outer diameter RB, said least inner diameter SN, and said largest inner diameter SX are defined to satisfy formulas of $$RA-SN \geqq 0.5,$$

$$RB-(SN+SX)/2 \geqq 0.5,$$

and $$-0.18 \leqq RB-(SN+SX)/2-(RA-SN) \leqq 0.12.$$

25. The method as defined in claim 21, wherein said cross-sectional diameter RA, said outer diameter RB, said least inner diameter SN, and said largest inner diameter SX are defined to satisfy formulas of $$RA-SN \leqq 0.9$$

and $$RB-(SN+SX)/2 \leqq 0.9.$$

26. The method as defined in claim 21, wherein said rotor is made of a material of at least one of aluminum, polycarbonate, and a polyacetal resin.

27. The method as defined in claim 21, wherein said stator is made of a material of at least one of an ethylenepropylene rubber having a hardness of 50 degrees in accordance with a scale A of a Japanese Industrial Standard and a chloroprene rubber.

28. The method as defined in claim 21, wherein said rotor is driven at a rotation speed from about 100 rpm to about 400 rpm.

29. The method as defined in claim 21, wherein said powder is toner.

30. The method as defined in claim 21, wherein said powder is a two-component development agent including toner and carriers.

31. An image forming apparatus, comprising:

a powder pump comprising:

a stator having a through-hole formed with two grooves extended in a stator spiral form; and a rotor configured and arranged for free rotation inside said through-hole of said stator, said rotor extending in a rotor spiral form such that spaces for accommodating a powder are formed between an outer circumferential surface of said rotor and an inner circumferential surface of said through-hole of said stator, and said rotor being configured to rotate so as to move said spaces and thereby to transfer said powder, wherein when said rotor has a cross-sectional diameter RA millimeters and an outer diameter RB millimeters, and said through-hole of said stator has a least inner diameter SN millimeters and a largest inner diameter SX millimeters, said cross-sectional diameter RA, said outer diameter RB, said least inner diameter SN, and said largest inner diameter SX are defined to satisfy formulas of $$RA-SN \geqq 0.40$$

and $$RB-(SN+SX)/2 \geqq 0.40.$$

32. The image forming apparatus as defined in claim 31, wherein said cross-sectional diameter RA, said outer diameter RB, said least inner diameter SN, and said largest inner diameter SX are defined to satisfy formulas of $$-0.18 \leqq RB-(SN+SX)/2-(RA-SN) \leqq 0.16.$$

33. The image forming apparatus as defined in claim 31, wherein said cross-sectional diameter RA, said outer diameter RB, said least inner diameter SN, and said largest inner diameter SX are defined to satisfy formula of $$-0.18 \leqq RB-(SN+SX)/2-(RA-SN) \leqq 0.12.$$

34. The image forming apparatus as defined in claim 31, wherein said cross-sectional diameter RA, said outer diameter RB, said least inner diameter SN, and said largest inner diameter SX are defined to satisfy formulas of $$RA-SN \geqq 0.5,$$

$$RB-(SN+SX)/2 \geqq 0.5,$$

and $$-0.18 \leqq RB-(SN+SX)/2-(RA-SN) \leqq 0.12.$$

35. The image forming apparatus as defined in claim 31, wherein said cross-sectional diameter RA, said outer diameter RB, said least inner diameter SN, and said largest inner diameter SX are defined to satisfy formulas of $$RA-SN \leqq 0.9$$

and $$RB-(SN+SX)/2 \leqq 0.9.$$

36. The image forming apparatus as defined in claim 31, wherein said rotor is made of a material of at least one of aluminum, polycarbonate, and a polyacetal resin.

37. The image forming apparatus as defined in claim 31, wherein said stator is made of a material of at least one of an ethylenepropylene rubber having a hardness of 50 degrees in accordance with a scale A of a Japanese Industrial Standard and a chloroprene rubber.

38. The image forming apparatus as defined in claim 31, wherein said rotor is driven at a rotation speed from about 100 rpm to about 400 rpm.

39. The image forming apparatus as defined in claim 31, wherein said powder is toner.

40. The image forming apparatus as defined in claim 31, wherein said powder is a two-component development agent including toner and carriers.

41. An image forming apparatus, comprising:

a powder pump comprising:

stator means having a through-hole formed with two grooves extended in a stator spiral form; and rotor means for rotating inside said through-hole of said stator means, said rotor means extending in a rotor spiral form such that spaces for accommodating a powder are formed between an outer circumferential surface of said rotor means and an inner circumferential surface of said through-hole of said stator means, wherein said rotor means is configured to rotate so as to move said spaces and thereby to transfer said powder, wherein when said rotor means has a cross-sectional diameter RA millimeters and an outer diameter RB millimeters, and said through-hole of said stator means has a least inner diameter SN millimeters and a largest inner diameter SX millimeters, said cross-sectional diameter RA, said outer diameter RB, said least inner diameter SN, and said largest inner diameter SX are defined to satisfy formulas of $$RA-SN \geqq 0.40 \text{ and}$$

$$RB-(SN+SX)/2 \geqq 0.40.$$

42. The image forming apparatus as defined in claim 41, wherein said cross-sectional diameter RA, said outer diameter RB, said least inner diameter SN, and said largest inner diameter SX are defined to satisfy formulas of $$-0.18 \leqq RB-(SN+SX)/2-(RA-SN) \leqq 0.16.$$

43. The image forming apparatus as defined in claim 41, wherein said cross-sectional diameter RA, said outer diameter RB, said least inner diameter SN, and said largest inner diameter SX are defined to satisfy formula of $$-0.18 \leqq RB-(SN+SX)/2-(RA-SN) \leqq 0.12.$$

44. The image forming apparatus as defined in claim 41, wherein said cross-sectional diameter RA, said outer diameter RB, said least inner diameter SN, and said largest inner diameter SX are defined to satisfy formulas of $$RA-SN \leqq 0.9$$

and $$RB-(SN+SX)/2 \leqq 0.9.$$

45. The image forming apparatus as defined in claim 41, wherein said rotor means is made of a material of at least one of aluminum, polycarbonate, and a polyacetal resin.

46. The image forming apparatus as defined in claim 41, wherein said stator means is made of a material of at least one of an ethylenepropylene rubber having a hardness of 50 degrees in accordance with a scale A of a Japanese Industrial Standard and a chloroprene rubber.

47. The image forming apparatus as defined in claim 41, wherein said rotor means is driven at a rotation speed from about 100 rpm to about 400 rpm.

48. The image forming apparatus as defined in claim 41, wherein said powder is toner.

49. The image forming apparatus as defined in claim 41, wherein said powder is a two-component development agent including toner and carriers.

50. A method of image forming, comprising the steps of:

forming a through-hole with two grooves extended in a stator spiral form in a stator; and arranging a rotor extending in a rotor spiral form such that spaces for accommodating a powder are formed between an outer circumferential surface of said rotor and an inner circumferential surface of said through-hole of said stator; and rotating said rotor so that said spaces are moved to transfer said powder, wherein when said rotor has a cross-sectional diameter RA millimeters and an outer diameter RB millimeters, and said through-hole of said stator has a least inner diameter SN millimeters and a largest inner diameter SX millimeters, said cross-sectional diameter RA, said outer diameter RB, said least inner diameter SN, and said largest inner diameter SX are defined to satisfy formulas of $$RA-SN \geqq 0.40$$

and $$RB-(SN+SX)/2 \geqq 0.40.$$

51. The method as defined in claim 50, wherein said cross-sectional diameter RA, said outer diameter RB, said least inner diameter SN, and said largest inner diameter SX are defined to satisfy formulas of $$-0.18 \leqq RB-(SN+SX)/2-(RA-SN) \leqq 0.16.$$

52. The method as defined in claim 50, wherein said cross-sectional diameter RA, said outer diameter RB, said least inner diameter SN, and said largest inner diameter SX are defined to satisfy formula of $$-0.18 \leqq RB-(SN+SX)/2-(RA-SN) \leqq 0.12.$$

53. The method as defined in claim 50, wherein said cross-sectional diameter RA, said outer diameter RB, said least inner diameter SN, and said largest inner diameter SX are defined to satisfy formulas of $$RA-SN \geqq 0.5,$$

$$RB-(SN+SX)/2 \geqq 0.5,$$

and $$-0.18 \leqq RB-(SN+SX)/2-(RA-SN) \leqq 0.12.$$

54. The method as defined in claim 50, wherein said cross-sectional diameter RA, said outer diameter RB, said least inner diameter SN, and said largest inner diameter SX are defined to satisfy formulas of $$RA-SN \leqq 0.9$$

and $$RB-(SN+SX)/2 \leqq 0.9.$$

55. The method as defined in claim 50, wherein said rotor is made of a material of at least one of aluminum, polycarbonate, and a polyacetal resin.

56. The method as defined in claim 50, wherein said stator is made of a material of at least one of an ethylenepropylene rubber having a hardness of 50 degrees in accordance with a scale A of a Japanese Industrial Standard and a chloroprene rubber.

57. The method as defined in claim 50, wherein said rotor is driven at a rotation speed from about 100 rpm to about 400 rpm.

58. The method as defined in claim 50, wherein said powder is toner.

59. The method as defined in claim 50, wherein said powder is a two-component development agent including toner and carriers.

60. A powder pump, comprising:

a stator having a through-hole formed with two grooves extended in a stator spiral form;

a rotor rotatably supported within an inside of said through-hole of said stator, said rotor extending in a rotor spiral form such that spaces for accommodating a powder are formed between an outer circumferential surface of said rotor and an inner circumferential surface of said through-hole of said stator, and said rotor rotates to move said spaces and thereby transfers said powder;

a cross-sectional engagement amount formed in said stator;

an outer diameter engagement amount formed in said rotor;

wherein RA is a cross-sectional diameter of the rotor, wherein RB is an outer diameter of the rotor, wherein SN is a least inner diameter of the through-hole of the stator, wherein SX is a largest inner diameter of the through-hole of the stator; and wherein the cross-sectional engagement amount is according to the equation RA−SN≧0.4 millimeters.

61. The powder pump of claim 60, wherein said rotor is made of a material of at least one of aluminum, polycarbonate, and a polyacetal resin.

62. The powder pump of claim 60, wherein said rotor is driven at a rotation speed from about 100 rpm to about 400 rpm.

63. The powder pump of claim 60, wherein said powder is toner.

64. The powder pump of claim 60, wherein said powder is a two-component development agent including toner and carriers.

65. A powder pump comprising, a stator having a through-hole formed with two grooves extended in a stator spiral form;

a rotor rotatably supported within an inside of said through-hole of said stator, said rotor extending in a rotor spiral form such that spaces for accommodating a powder are formed between an outer circumferential surface of said rotor and an inner circumferential surface of said through-hole of said stator, and said rotor rotates to move said spaces and thereby transfers said powder;

a cross-sectional engagement amount formed in said stator;

an outer diameter engagement amount formed in said rotor;

wherein RA is a cross-sectional diameter of the rotor, wherein RB is an outer diameter of the rotor, wherein SN is a least inner diameter of the through-hole of the stator, wherein SX is a largest inner diameter of the through-hole of the stator; and wherein the outer diameter engagement amount is according to the equation RB−(SN+SX)/2≧0.4 millimeters.

66. A powder pump comprising, a stator having a through-hole formed with two grooves extended in a stator spiral form;

a rotor rotatably supported within an inside of said through-hole of said stator, said rotor extending in a rotor spiral form such that spaces for accommodating a powder are formed between an outer circumferential surface of said rotor and an inner circumferential surface of said through-hole of said stator, and said rotor rotates to move said spaces and thereby transfers said powder;

a cross-sectional engagement amount formed in said stator;

an outer diameter engagement amount formed in said rotor;

wherein RA is a cross-sectional diameter of the rotor, wherein RB is an outer diameter of the rotor, wherein SN is a least inner diameter of the through-hole of the stator, wherein SX is a largest inner diameter of the through-hole of the stator; and wherein said cross-sectional diameter RA, said outer diameter RB, said least inner diameter SN, and said largest inner diameter SX are defined to satisfy a formula of $$-0.18 \leqq RB-(SN+SX)/2-(RA-SN) \geqq 0.16.$$

67. A powder pump comrising, a stator having a through-hole formed with two grooves extended in a stator spiral form;

a rotor rotatably supported within an inside of said through-hole of said stator, said rotor extending in a rotor spiral form such that spaces for accommodating a powder are formed between an outer circumferential surface of said rotor and an inner circumferential surface of said through-hole of said stator, and said rotor rotates to move said spaces and thereby transfers said powder;

a cross-sectional engagement amount formed in said stator;

an outer diameter engagement amount formed in said rotor;

wherein RA is a cross-sectional diameter of the rotor, wherein RB is an outer diameter of the rotor, wherein SN is a least inner diameter of the through-hole of the stator, wherein SX is a largest inner diameter of the through-hole of the stator; and wherein said cross-sectional diameter RA, said outer diameter RB, said least inner diameter SN, and said largest inner diameter SX are defined to satisfy formulas of $$RA-SN \geqq 0.4,\ RB-(SN+SX)/2 \geqq 0.4, \text{ and}$$

$$-0.18 \leqq RB-(SN+SX)/2-(RA-SN) \leqq 0.12.$$

68. A powder pump comprising, a stator having a through-hole formed with two grooves extended in a stator spiral form;

a rotor rotatably supported within an inside of said through-hole of said stator, said rotor extending in a rotor spiral form such that spaces for accommodating a powder are formed between an outer circumferential surface of said rotor and an inner circumferential surface of said through-hole of said stator, and said rotor rotates to move said spaces and thereby transfers said powder;

a cross-sectional engagement amount formed in said stator;

an outer diameter engagement amount formed in said rotor;

wherein RA is a cross-sectional diameter of the rotor, wherein RB is an outer diameter of the rotor, wherein SN is a least inner diameter of the through-hole of the stator, wherein SX is a largest inner diameter of the through-hole of the stator; and wherein said cross-sectional diameter RA, said outer diameter RB, said least inner diameter SN, and said largest inner diameter SX are defined to satisfy formulas of $$RA-SN \geqq 0.5,\ RB-(SN+SX)/2 \geqq 0.5, \text{ and}$$

$$-0.18 \leqq RB-(SN+SX)/2-(RA-SN) \leqq 0.12.$$

69. A powder pump comprising, a stator having a through-hole formed with two grooves extended in a stator spiral form;

a rotor rotatably supported within an inside of said through-hole of said stator, said rotor extending in a rotor spiral form such that spaces for accommodating a powder are formed between an outer circumferential surface of said rotor and an inner circumferential surface of said through-hole of said stator, and said rotor rotates to move said spaces and thereby transfers said powder;

a cross-sectional engagement amount formed in said stator;

an outer diameter engagement amount formed in said rotor;

wherein RA is a cross-sectional diameter of the rotor, wherein RB is an outer diameter of the rotor, wherein SN is a least inner diameter of the through-hole of the stator, wherein SX is a largest inner diameter of the through-hole of the stator; and wherein said cross-sectional diameter RA, said outer diameter RB, said least inner diameter SN, and said largest inner diameter SX are defined to satisfy formulas of $$RA-SN \leqq 0.9 \text{ and}$$

$$RB-(SN+SX)/2 \leqq 0.9.$$

70. A powder pump comprising, a stator having a through-hole formed with two grooves extended in a stator spiral form;

a rotor rotatably supported within an inside of said through-hole of said stator, said rotor extending in a rotor spiral form such that spaces for accommodating a powder are formed between an outer circumferential surface of said rotor and an inner circumferential surface of said through-hole of said stator, and said rotor rotates to move said spaces and thereby transfers said powder;

a cross-sectional engagement amount formed in said stator;

an outer diameter engagement amount formed in said rotor;

wherein RA is a cross-sectional diameter of the rotor, wherein RB is an outer diameter of the rotor, wherein SN is a least inner diameter of the through-hole of the stator, wherein SX is a largest inner diameter of the through-hole of the stator; and wherein said stator is made of a material of at least one of an ethylenepropylene rubber having a hardness of 50 degrees in accordance with a scale A of a Japanese Industrial Standard and a chloroprene rubber.

71. A powder pump apparatus, comprising:

means for forming a through-hole with two grooves extended in a stator spiral form in a stator; and means for arranging a rotor extending in a rotor spiral form such that spaces for accommodating a powder are formed between an outer circumferential surface of said rotor and an inner circumferential surface of said through-hole of said stator; and means for rotating said rotor so that said spaces are moved to transfer said powder, wherein when said rotor has a cross-sectional diameter RA millimeters and an outer diameter RB millimeters, and said through-hole of said stator has a least inner diameter SN millimeters and a largest inner diameter SX millimeters, said cross-sectional diameter RA, said outer diameter RB, said least inner diameter SN, and said largest inner diameter SX are defined to satisfy formulas of $$RA-SN \geqq 0.40$$

and $$RB-(SN+SX)/2 \geqq 0.40.$$

* * * * *